US010424836B2

(12) United States Patent
McMichael et al.

(10) Patent No.: US 10,424,836 B2
(45) Date of Patent: Sep. 24, 2019

(54) HORIZON NULLING HELIX ANTENNA

(71) Applicant: The MITRE Corporation, McLean, VA (US)

(72) Inventors: Ian T. McMichael, Stow, MA (US); Steven R. Best, Townsend, MA (US); Erik T. Lundberg, Cambridge, MA (US); Eddie N. Rosario, Mathuen, MA (US)

(73) Assignee: The MITRE Corporation, McLean, VA (US)

( * ) Notice: Subject to any disclaimer, the term of this patent is extended or adjusted under 35 U.S.C. 154(b) by 186 days.

(21) Appl. No.: 15/276,353

(22) Filed: Sep. 26, 2016

(65) Prior Publication Data

US 2018/0090830 A1 Mar. 29, 2018

(51) Int. Cl.
*H01Q 11/08* (2006.01)
*H01Q 1/36* (2006.01)
(Continued)

(52) U.S. Cl.
CPC ..... *H01Q 1/362* (2013.01); *H01Q 1/241* (2013.01); *H01Q 5/321* (2015.01); *H01Q 9/145* (2013.01);
(Continued)

(58) Field of Classification Search
CPC ..... H01Q 1/24; H01Q 1/241; H01Q 1/242; H01Q 1/245; H01Q 1/36; H01Q 1/362; H01Q 3/26; H01Q 3/2611; H01Q 3/2617; H01Q 3/2623; H01Q 3/29; H01Q 3/30; H01Q 3/34; H01Q 9/27; H01Q 9/28; H01Q 9/44; H01Q 21/24; H01Q 21/245; H01Q 21/29; H01Q 11/00; H01Q 11/02; H01Q 11/04; H01Q 11/14; H01Q 11/16;
(Continued)

(56) References Cited

U.S. PATENT DOCUMENTS 4,148,030 A * 4/1979 Foldes ..... H01Q 11/08 343/895
5,721,557 A * 2/1998 Wheeler ..... H01Q 11/08 343/749
(Continued)

FOREIGN PATENT DOCUMENTS

| | | |
|---|---|---|
| JP | 2002-76764 | 3/2002 |
| JP | 2004-254168 | 9/2004 |
| JP | 2016-54454 | 4/2016 |

OTHER PUBLICATIONS

Lamensdorf, David et al. "Dual-Band Quadrifilar Helix Antenna," 2002, IEEE, vol. 3, Antennas and Propagation Society International Symposium; 4 pages.
(Continued)

*Primary Examiner* — Daniel Munoz
*Assistant Examiner* — Patrick R Holecek
(74) *Attorney, Agent, or Firm* — Morrison & Foerster LLP

(57) ABSTRACT

A helix antenna including a first radiating element extending helically about a longitudinal axis and tuned to resonate in a frequency band, a reactive element electrically connected to a first end of the first radiating element, and a second radiating element extending helically about the axis and electrically connected to the reactive element at a first end of the second radiating element, wherein the second radiating element is tuned to resonate in the frequency band.

20 Claims, 17 Drawing Sheets

(51) Int. Cl.

| | |
|---|---|
| ***H01Q 1/24*** | (2006.01) |
| ***H01Q 21/24*** | (2006.01) |
| ***H01Q 9/14*** | (2006.01) |
| ***H01Q 21/30*** | (2006.01) |
| ***H01Q 5/321*** | (2015.01) |

(52) U.S. Cl.
CPC ..... *H01Q 11/08* (2013.01); *H01Q 21/24* (2013.01); *H01Q 21/30* (2013.01)

(58) Field of Classification Search
CPC ..... H01Q 11/18; H01Q 11/08; H01Q 11/083; H01Q 11/086; H01Q 3/2605; H01Q 3/2629; H01Q 3/2635; H01Q 3/2641; H01Q 3/2652; H01Q 3/2664; H01Q 3/32; H01Q 3/36; H01Q 3/38; H01Q 1/243
See application file for complete search history.

(56) References Cited

U.S. PATENT DOCUMENTS

| | | | | |
|---|---|---|---|---|
| 6,049,305 | A | 4/2000 | Tassoudji et al. | |
| 6,094,178 | A | 7/2000 | Sanford | |
| 6,229,489 | B1 | 5/2001 | Holshouser et al. | |
| 6,653,987 | B1 * | 11/2003 | Lamensdorf | H01Q 1/38 343/853 |
| 6,720,935 | B2 | 4/2004 | Lamensdorf et al. | |
| 6,859,181 | B2 | 2/2005 | Colburn et al. | |
| 7,245,268 | B2 | 7/2007 | O'Neill, Jr. et al. | |
| 7,385,555 | B2 * | 6/2008 | Mahmoud | H01Q 1/28 343/700 MS |
| 7,639,202 | B2 | 12/2009 | Takaoka et al. | |
| 7,920,860 | B2 | 4/2011 | Chari et al. | |
| 8,212,738 | B2 | 7/2012 | Leisten et al. | |
| 8,242,964 | B2 | 8/2012 | Nishi et al. | |
| 8,447,292 | B2 | 5/2013 | Chari et al. | |
| 8,456,375 | B2 | 6/2013 | Leisten | |
| 8,605,002 | B2 | 12/2013 | Nishi et al. | |
| 8,786,503 | B2 | 7/2014 | Apostolos et al. | |
| 9,774,089 | B2 | 9/2017 | Tatarnikov et al. | |
| 2007/0120761 | A1 | 5/2007 | Candal | |
| 2008/0180336 | A1 | 7/2008 | Bauregger | |
| 2011/0254755 | A1 | 10/2011 | DiNallo | |
| 2012/0287016 | A1 | 11/2012 | Zalinska et al. | |
| 2014/0139384 | A1 | 5/2014 | Elliot et al. | |
| 2014/0253410 | A1 | 9/2014 | DiNallo et al. | |
| 2015/0346345 | A1 | 12/2015 | Bartone | |
| 2016/0268691 | A1 * | 9/2016 | Tatarnikov | H01Q 11/08 |
| 2018/0090829 | A1 | 3/2018 | Mcmichael et al. | |

OTHER PUBLICATIONS

Amin, M. et al. "Dual-mode compact structure comprising of side-fed bifilar and quadrifilar helix antenna," IET Microw. Antennas Propag., 2007, 1, (5), pp. 1006-1012.

Zhaoqing, Liu et al. "Design of GPS Receiving Antenna for Amateur Radio Application," 2012, ECE 593 Antennas and Propagation, Final Project Report; pp. 1-5.

Krzysztofik, W. J. "Radiation Properties of Quadrifilar-Helix Antenna—An Analytical Approach," 2012, IEEE, Antennas and Propagation Society International Symposium; 2 pages.

Lizzi, Leonardo et al. "Simple antenna structure enabling the simultaneous excitation of two different polarisation and radiation modes." IET Microw. Antennas Propag., 2014, vol. 8 Iss. 12, pp. 921-930.

McMichael, Ian T. et al., U.S. Office Action dated Jul. 18, 2018, directed to U.S. Appl. No. 15/276,227; 11 pages.

* cited by examiner

L1

L2

HORIZON NULLING HELIX ANTENNA

STATEMENT REGARDING FEDERALLY SPONSORED RESEARCH OR DEVELOPMENT

This invention was made with Government support under U.S. Government contract W56KGU-14-C-0010 awarded by the U.S. Department of the Army. The Government has certain rights in this invention.

CROSS REFERENCE TO RELATED APPLICATIONS

This application is related to U.S. application Ser. No. 15/276,227, titled "DECOUPLED CONCENTRIC HELIX ANTENNA," filed on Sep. 26, 2016, the entire contents of which are incorporated herein by reference.

FIELD OF THE INVENTION

This invention relates generally to radio-frequency antennas and, more specifically, to helix radio-frequency antennas.

BACKGROUND OF THE INVENTION

Global Navigation Satellite Systems (GNSS) such as the U.S. NAVSTAR Global Positioning System (GPS), the European Galileo system, the Chinese Beidou system, and the Russian GLONASS system are increasingly relied upon to provide synchronized timing that is both accurate and reliable. (Reference is made to GPS below, by way of example and simplicity, but similar characteristics and principles of operation apply to other GNSS.) GPS antennas are used to receive GPS signals and provide those signals to a GPS receiver. GPS antennas may amplify and filter the received GPS signals prior to passing them to the GPS receiver. The GPS receiver can then calculate position, velocity, and/or time from the signals collected by the GPS antenna.

Accurate GPS-based navigation and timing systems typically rely on receiving signals from at least four GPS satellites simultaneously. GPS timing systems can provide time when a single GPS satellite is observed if the position of the antenna is already known. Analysis has shown that a GPS timing antenna with a half power beam width (HPBW) of 60° will have access to at least three satellites 95% of the time, which is sufficient for timing applications. GPS satellites transmit right-hand circularly polarized (RHCP) signals, and thus, GPS antennas must be right-hand circularly polarized.

GPS timing antennas at fixed sites are susceptible to unintentional interference, such as out-of-band and multipath signals, as well as intentional interference from ground-based GPS jammers commonly employed to deny, degrade, and/or deceive GPS derived position and time to prevent GPS tracking of commercial or privately owned vehicles.

Several types of antennas have been previously developed to mitigate interference while maintaining a sufficient RHCP HPBW for GPS applications, such as large antenna arrays, horizon ring nulling antennas, and shorted annular ring antennas. Many of these steer a null (local gain minimum) in the direction from which interfering signals are received (such as the horizon). For example, large antenna arrays, such as controlled reception pattern antennas (CRPA), steer a null in the direction of the interference using active circuitry. While CRPAs can achieve exceptional nulling in a particular direction, they can be large due to the multiple antenna elements that are necessary for null steering, are typically expensive due to the required active electronics, and can only null a finite number of interfering signals.

Horizon ring nulling (HRN) antennas can achieve a measured RHCP null depth (i.e., zenith-to-horizon gain ratio) of approximately −45 dB on average around the entire azimuth. The HRN is composed of a shorted annular ring patch combined with a circular patch with amplitude and phase weighting to create a null at the horizon. While the HRN's performance is exceptional with regard to its horizon nulling capability, its cost is relatively high due to the required active electronics. Additionally, the exceptional null of the HRN only applies to incident RHCP interference and not to other polarizations like vertical linear, horizontal linear, or left-hand circular polarization (LHCP).

The quadrifilar helix antenna has been researched extensively for GPS and other applications. Typical short helix antennas have a zenith-to-horizon ratio that is insufficient for horizon nulling, and long helix antennas that may have sufficient nulling at the horizon do not have sufficient HPBW for timing reception.

BRIEF SUMMARY OF THE INVENTION

Described within are helix antennas with collinear sections separated by reactive elements. In some embodiments, the collinear sections are configured to operate at the same frequency band, and the reactive elements are configured to cause a phase difference between the waveforms excited in the sections. In some embodiments, the reactive elements are configured to create a deep null in the gain pattern of the antenna. The deep null can be placed at the horizon for ground based interference rejection. The interference rejection can apply to all possible polarizations of incident waves such as RHCP, LHCP, vertical linear, and horizontal linear.

According to some embodiments a helix antenna comprises a first radiating element extending helically about a longitudinal axis and tuned to resonate in a frequency band, a reactive element electrically connected to a first end of the first radiating element, and a second radiating element extending helically about the axis and electrically connected to the reactive element at a first end of the second radiating element, wherein the second radiating element is tuned to resonate in the frequency band.

In any of these embodiments, the reactive element may be an inductor.

In any of these embodiments, the reactive element may be configured to shift a phase of a signal generated by the second radiating element relative to a phase of a signal generated by the first radiating element such that the signal generated by the second radiating element destructively interferes with the signal generated by the first radiating element in a direction extending transversely to the longitudinal axis.

In any of these embodiments, the reactive element may be configured to shift a phase of a signal generated by the second radiating element relative to a phase of a signal generated by the first radiating element such that the signal generated by the second radiating element constructively interferes with the signal generated by the first radiating element in a direction extending along the longitudinal axis.

In any of these embodiments, a second end of the first radiating element may comprise a feed point for providing signals to the first and second radiating elements. In any of these embodiments, the helix antenna may generate a circularly polarized radiation field in response to receiving a signal through the feed point.

In any of these embodiments, a phase center of the second radiating element may be displaced along the longitudinal axis of the phase center of the first radiating element such that a signal generated by the second radiating element constructively interferes with a signal generated by the first radiating element in a direction extending along the longitudinal axis.

In any of these embodiments, the helix antenna may be configured with a resonance frequency gain null extending circumferentially about the longitudinal axis. In any of these embodiments, the gain null may be at least 45° from the longitudinal axis. In any of these embodiments, the gain null may be at least 80° from the longitudinal axis.

In any of these embodiments, the gain null may comprise a gain that is at least 20 decibels (dB) less than a gain at a zenith of the antenna. In any of these embodiments, the gain may be at least 30 dB less than the gain at the zenith of the antenna. In any of these embodiments, the frequency band may be an L1, L2, or L5 GPS frequency band.

In any of these embodiments, a helical pitch of the first radiating element may be different than a helical pitch of the second radiating element. In any of these embodiments, the first radiating element and the second radiating element each may comprise greater than one turn.

In any of these embodiments, the antenna may comprise four electrically conductive arms extending helically about the longitudinal axis, wherein one of the arms comprises the first and second radiating elements and the one or more reactive elements.

In any of these embodiments, a waveform generated by the first radiating element may destructively interfere with a waveform generated by the second radiating element in a direction perpendicular to the longitudinal axis at a frequency in the frequency band. In any of these embodiments, the antenna gain may be at least half the magnitude of the gain at a zenith of the antenna at all angles less than or equal to 30° from the axis at an operating frequency.

According to some embodiments, a single-band helix antenna comprises multiple electrically conductive arms extending helically about a longitudinal axis from a first end of the antenna, wherein each arm comprises an upper segment, a lower segment, and at least one reactive element that electrically connects the upper segment to the lower segment, a ground plane at the first end of the antenna that is electrically isolated from the multiple electrically conductive arms, and a feed network electrically connected to the multiple electrically conductive arms for feeding a circularly polarized signal.

According to some embodiments, a helix antenna comprises at least one electrically conductive arm extending helically about a longitudinal axis from a first end of the antenna, wherein the at least one arm comprises an upper segment, a lower segment, and at least one reactive element that electrically connects the upper segment to the lower segment, and a waveform generated by the upper segment constructively interferes with a waveform generated by the lower segment in a direction extending along the longitudinal axis.

BRIEF DESCRIPTION OF THE DRAWINGS

FIGS. 8A-1 and 8A-2 include polar charts and rectangular charts, respectively, of the simulated L1 and L2 elevation gain patterns of a dual-band horizon nulling concentric quadrifilar helix antenna, according to some embodiments;

DETAILED DESCRIPTION OF THE INVENTION

Figure 1:
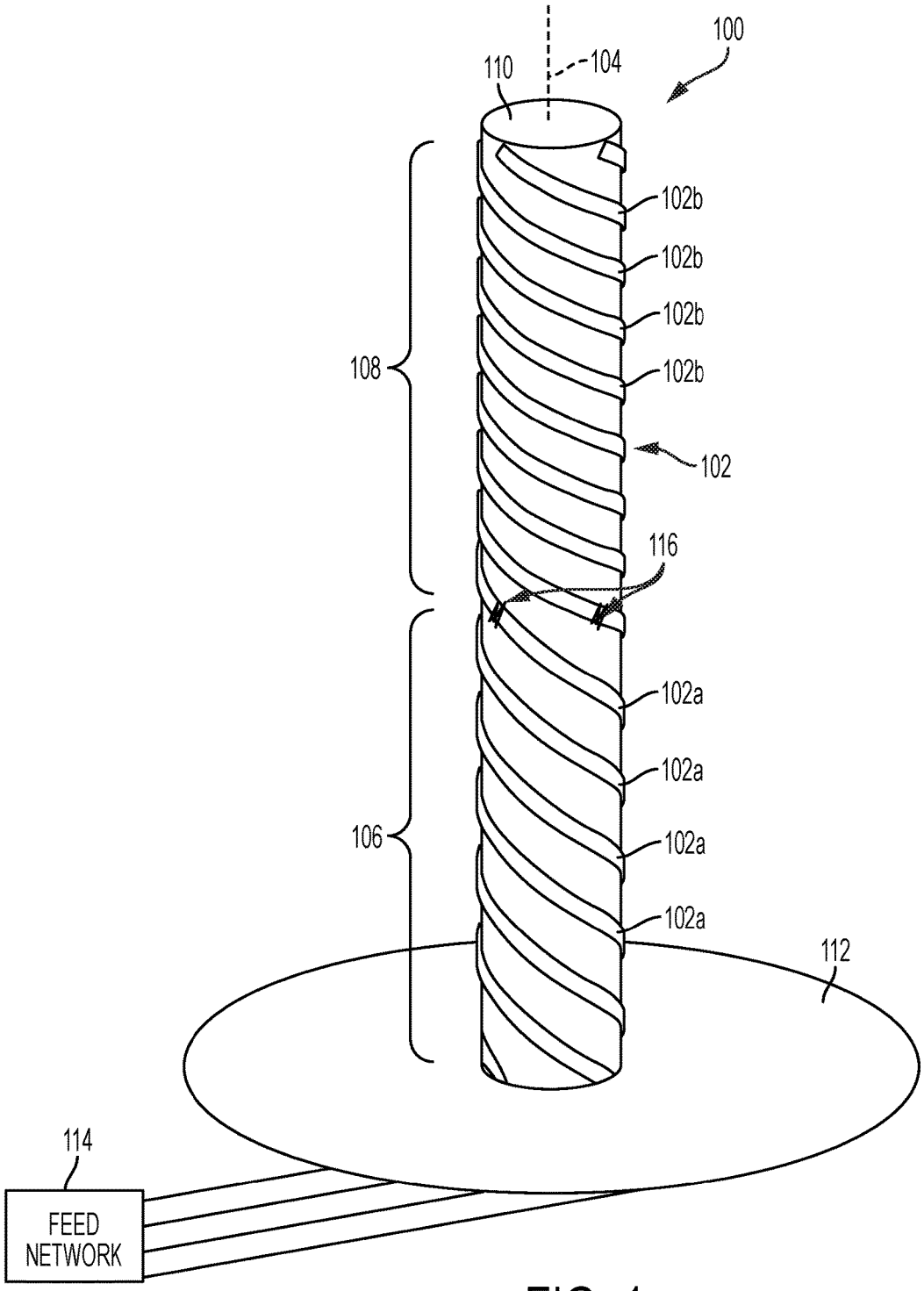
FIG. 1 illustrates a horizon nulling quadrifilar helix antenna, according to some embodiments.

Described herein are single and multi-band helix antennas that can be configured for GPS timing reception. A first aspect of the invention is directed to reactively loaded, series-fed, collinear helix antennas that can include a deep null in the total field gain pattern at the horizon in a full ring around azimuth for ground based interference rejection. The interference rejection can apply to all possible polarizations of incident waves. In some embodiments, helical radiating arms of the antenna may be divided into at least two sections that are connected in series via one or more reactive elements, such as inductors. The inductors can be configured to cause a phase difference between the waveform generated by a first section and the waveform generated by a second section such that the waveforms interact destructively in the direction of the horizon and constructively in the zenith direction. The destructive interference at the horizon can create a deep null in the gain that results in horizon-based (e.g., ground based) interference rejection.

A second aspect of the invention is directed to multi-band helix antennas in which an inner radiating helix configured for operating in a first frequency band is nested within an outer radiating helix configured for operating in a second frequency band. The radiating arms of the outer helix can include trap circuits configured for high impedance within or near the operating frequency of the inner helix. The trap circuit prevents excitation of the outer helix at the operating frequency of the inner helix such that the radiation of the inner helix is not shielded by the outer helix. This can reduce disruptions to the gain pattern of the inner helix caused by the outer helix. The nesting of the helices enables multi-band operation in a single compact antenna.

According to some embodiments, features of the horizon nulling antenna are combined with features of the multi-band nested helical antenna for a multi-band horizon nulling helix antenna. Each helix can be configured with reactive elements to create a deep null in the gain pattern at the horizon. The decoupling of the outer helix from the inner helix via the trap circuits preserves the deep null in the gain pattern. Combining these features can result in a multi-band helix antenna with a deep null in the total field gain pattern at the horizon in a full ring around azimuth for ground based interference rejection.

Antennas, according to some embodiments described herein, are low cost RHCP antennas with sufficient beamwidth and total field horizon nulling for GPS and other applications.

In the following description of the disclosure and embodiments, reference is made to the accompanying drawings in which are shown, by way of illustration, specific embodiments that can be practiced. It is to be understood that other embodiments and examples can be practiced, and changes can be made, without departing from the scope of the disclosure.

In addition, it is also to be understood that the singular forms "a," "an," and "the" used in the following description are intended to include the plural forms as well, unless the context clearly indicates otherwise. It is also to be understood that the term "and/or," as used herein, refers to and encompasses any and all possible combinations of one or more of the associated listed items. It is further to be understood that the terms "includes, "including," "comprises," and/or "comprising," when used herein, specify the presence of stated features, integers, steps, operations, elements, components, and/or units, but do not preclude the presence or addition of one or more other features, integers, steps, operations, elements, components, units, and/or groups thereof.

Reference is made herein to antennas including radiating elements of a particular size and shape. For example, certain embodiments of radiating elements are described as having a shape and a size compatible with operation over a particular frequency range (e.g., 1-2 GHz). Those of ordinary skill in the art would recognize that other shapes of antenna elements may also be used and that the size or other physical characteristic of one or more radiating elements may be selected for operation over any frequency range in the RF frequency range (e.g., any frequency in the range from below 20 MHz to above 50 GHz).

Reference is sometimes made herein to generation of a radiating beam having a particular shape or beam width. Those of ordinary skill in the art would appreciate that antenna beams having other shapes may also be used and may be provided using known techniques, such as by inclusion of amplitude and phase adjustment circuits into appropriate locations in an antenna feed circuit and/or multi antenna element network.

Although antennas in GPS receivers operate in the receive mode, standard antenna engineering practices characterize antennas in the transmit mode. According to the well-known antenna reciprocity theorem, however, antenna characteristics in the receive mode correspond to antenna characteristics in the transmit mode. Accordingly, the below description provides certain characteristics of antennas operating in a transmit mode with the intention of characterizing antennas equally in the receive mode.

Horizon Nulling Antenna

Described below are embodiments of reactively loaded, series-fed, collinear helix antennas. According to some embodiments, the antenna is configured with a deep null in the total field gain pattern at the horizon in a full ring around azimuth for ground based interference rejection. The interference rejection can apply to all possible polarizations of incident waves.

FIG. 1 illustrates a helix antenna 100 according to one embodiment. Antenna 100 includes four arms 102 wound helically about a cylindrical core 110 with a central longitudinal axis 104, forming a quadrifilar helix antenna. The arms extend from a lower end, where they can be electrically connected to a feed network 114, and terminate at an upper end. Each arm includes two radiating elements—a lower radiating element 102*a* and an upper radiating element 102*b*. The radiating elements of an arm 102 are connected in series by one or more reactive elements 116. The four lower radiating elements 102*a* form a lower section 106 of the helix antenna 100, and the four upper radiating elements form an upper section 108 of the helix antenna 100, in which the lower section 106 is electrically connected to the upper section 108 by the reactive elements 116. The arms are preferably left-hand wound for right-hand circular polarization. In some embodiments, the arms are preferably right-hand wound for left-hand circular polarization The lower and upper sections are tuned for resonant operation in the same frequency band. As such, helix antenna 100 is a single-band antenna. In other words, the lower and upper sections are configured such that the resonant frequency of each is the same or substantially the same. For example, according to one embodiment in which the helix antenna 100 is configured to operate at the L1 GPS frequency band, the upper and lower sections are each designed with a resonant frequency within the L1 band. In practice, the actual resonant frequency of the upper and lower sections may differ by some amount from one another due to variabilities of the physical implementation. However, the difference in the resonant frequencies is small relative to the bandwidth within which the antenna is designed to operate. According to some embodiments, the antenna is configured for resonant operation in a predefined frequency band. The predefined frequency band may be a band defined by a frequency allocation authority. In some embodiments, the predefined frequency band is a satellite communication band, such as a GPS, GLONASS, Beidou, or Galileo band.

The one or more reactive elements 116 connecting the lower and upper radiating elements of an arm can be configured to cause a phase shift between respective waveforms generated by the two elements that can result in a gain null at the horizon and/or an increase in gain in a direction extending along the longitudinal axis 104. The phase shifting of the waveforms generated by the lower and upper elements causes the waveforms to constructively interfere in a direction extending along the longitudinal axis 104 (i.e., in the direction of the zenith) and destructively interfere in a direction extending orthogonal to the longitudinal axis 104 (i.e., in the direction of the horizon). The destructive interference results in a null in the gain pattern at the horizon about the azimuth, and the constructive interference results in a higher gain main beam toward zenith.

The radiation from each radiating element is 180° out of phase in the direction of the horizon around all azimuth, which results in destructive interference between the radiation generated by the lower element and the radiation generated by the upper element. This destructive interference results in a null in the gain pattern at the horizon. The vertical displacement of the two radiating elements creates a different phase differential in the zenith direction compared to the horizon direction such that the radiation from each element is in phase in the zenith direction. In other words, at the point that the waveform of the lower radiating element "catches up" to the upper radiating element, the waveform of the energy generated by the lower radiating element is in phase with the waveform of the energy generated by the upper radiating element. This constructive interference can increase the gain in the zenith direction.

In some embodiments, reactive elements 116 may be any component or feature that shifts the phase of a signal generated by an upper radiating element relative to a lower radiating element of an arm. The reactive elements 116 may introduce capacitance, inductance, or some combination thereof. In some embodiments, reactive elements 116 are passive elements that are inductive, capacitive, or a combination thereof. In some embodiments, one or more reactive elements may be a discrete component such as a surface mount inductor or capacitor. In other embodiments, one or more reactive elements may be a distributed element. For example, the reactive element could be configured by a change in the geometry of the radiating element that introduces inductance. In some embodiments, the reactive elements 116 change the impedance of the antenna, and as such, the configuration of the reactive elements (e.g., the inductance of an inductor) is selected for phase delay as well as for impedance matching.

In general, each of the upper and lower radiating elements extend half an operating frequency wavelength along the longitudinal axis 104. The reactive elements 116 may be located midway along the arms with respect to the longitudinal axis. In some embodiments, the phase center of the signals generated one or more of the upper and lower radiating elements may not be in the middle (along the longitudinal axis) of the respective element, and the reactive elements 116 may be shifted along the longitudinal axis accordingly.

The cross section of helix antenna 100 is generally circular and uniform along the longitudinal axis. Other embodiments may have noncircular cross sections, such as triangular, rectangular, or hexagonal cross sections. The diameter and pitches of the helices may be selected based on the desired impedance and operating bandwidth of the antenna. A ground plane 112 may be located at the lower end of the helix antenna 100 to reflect energy toward the upper end to minimize back lobes. Since the lower section 106 is closer to the ground plane 112 than the upper section 108, the radiation patterns of the two sections would be different if the configuration of the upper and lower radiating elements were the same. To account for the effects of the ground plane, the upper radiating element has a different helical pitch than the lower radiating element. As illustrated in FIG. 1, the upper radiating element has a smaller pitch than the lower radiating element. Since the upper radiating element extends the same amount along the longitudinal axis as the lower radiating element, the smaller pitch of the upper radiating element results in more turns such that the length of the upper radiating element is greater than the length of the lower radiating element. In some embodiments, the upper radiating element has a greater pitch than the lower radiating element, leading to fewer turns and a shorter length than the lower radiating element.

In some embodiments, connectors are provided at the ground plane for connection to feed points at the base of the arms. The signal line of a connector may be electrically connected to the feed point of an arm, and the ground line of the connector may be connected to the ground plane. The arms are excited through the feed points with feed signals in phase quadrature to obtain circular polarization. The choice of specific feed network configuration depend on design factors known to those skilled in the art, such as manufacturability, reliability, cost, etc.

In some embodiments, the ground plane may be formed as a conducting film, such as a metal film (e.g., aluminum, copper, gold, silver, etc.), deposited on an underlying substrate. In some embodiments, the ground plane is formed of sheet metal or machined metal and may provide structural support for the antenna. In some embodiments, a ground plane is omitted.

The arms may be formed from any conductive material, such as copper, aluminum, gold, etc. The arms may be in the form of wire, strips, traces, etc. According to some embodiments, the arms are sufficiently rigid that they are self-supporting when formed into helices. In some embodiments, the arms are disposed on or embedded within a dielectric substrate, such as a flexible printed circuit board, that is shaped such that the arms form helices when the flexible printed circuit board is formed into a cylinder. In some embodiments, the arms may be supported by a support structure, such as a cylindrical support structure. For example, a Styrofoam cylinder may be used to provide structural support to the arms. Foam typically has a dielectric constant of less than 1.1. Higher dielectric constant material may allow the antenna to be made smaller, but also may reduce bandwidth (and radiation resistance).

Although antenna 100 includes four arms, other embodiments may include any number of arms, such as one, two, three, eight, etc. without departing from the principles described above. In some embodiments, the arms have an electrically open termination at the upper end. In other embodiments, one or more arms are electrically connected to one or more other arms, for example, for impedance matching.

The configuration of the upper and lower sections of the antenna may be selected based on the desired properties for the specific design application (e.g., operating bandwidth, feed network, size, power, weight, cost, etc.) according to known methods. Configurable parameters include helix diameter, number of turns, antenna height, radiating element length, etc. According to some embodiments, one or more parameters are selected as a function of the operating wavelength. For example, the radiating element length (e.g., length of the lower radiating element from the feed point to the reactive element if the radiating element were unwound) may be less than 3.0λ, less than 2.0λ, less than 1.5λ, less than 1.0λ, less than 0.75λ, less than 0.5λ, or less than 0.25λ. According to some embodiments, the length may be greater than 0.1λ, greater than 0.25λ, greater than 0.5λ, greater than 0.75λ, greater than 1.0λ, greater than 1.25λ, greater than 1.5λ, or greater than 2.0λ.

Similarly, the height of the lower and/or upper sections of the antenna may be selected as a function of the operating wavelength. According to some embodiments, the height of a section may be less than 3.0λ, less than 2.0λ, less than 1.5λ, less than 1.2λ, less than 1.0λ, less than 0.75λ, less than 0.5λ, or less than 0.25. According to some embodiments, the height of a section may be greater than 0.1λ, greater than 0.25λ, greater than 0.5λ, greater than 0.75λ, greater than 0.8λ, greater than 1.0λ, greater than 1.25λ, greater than 1.5λ, or greater than 2.0λ, In some embodiments, the height of a section is preferably about 0.5λ.

In some embodiments, the number of turns completed by the lower and/or upper sections may be less than or equal to one, less than or equal to two, less than or equal to three, or less than or equal to four. In some embodiments, the number of turns completed by the lower and/or upper sections may be greater than or equal to one-half, greater than or equal to three-quarters, greater than or equal to one and a quart, or greater than or equal to one and a half.

According to some embodiments, the reactive elements can be configured to steer a null transversely to the longitudinal axis in a direction other than the horizon. By altering the design parameters (e.g., inductance) and/or locations of the reactive elements, the null can be steered in a direction extending at an angle to the horizon. According to some embodiments, the peak gain null may be steered to a direction extending at greater than 2°, greater than 5°, greater than 10°, greater than 15°, greater than 30°, greater than 45°, or greater than 60° from the horizon. According to some embodiments, the peak gain null may be steered to a direction extending at less than 60°, less than 45°, less than 30°, less than 15°, less than 10°, less than 5°, or less than 2° from the horizon.

Simulated Performance of Horizon Nulling Antenna

FIGS. 2A-2D illustrates the simulated gain pattern for a modeled helix antenna according to the configuration of FIG. 1. The modeled helix antenna is configured to operate in the GPS L1 frequency band, with a nominal operating frequency of 1575.42 MHz. The height of the modeled antenna along the longitudinal axis from the ground plane to the termination point of the arms is about 200 mm, and the diameter is about 26 mm. There are four arms, evenly spaced 90° apart, that are fed in quadrature. The ground plane is about 180 mm in diameter. The reactive elements are inductors with an inductance of 47 nH and are located at 100 mm along the longitudinal axis from the ground plane such that the lower and upper sections are of equal height (extent along the longitudinal axis).

Figure 2B:
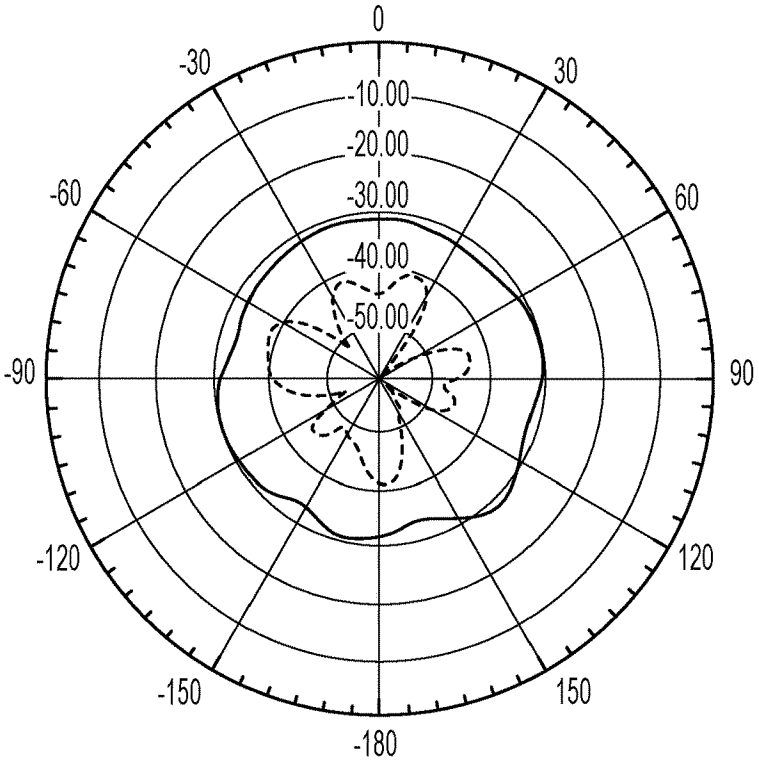
FIG. 2B is a rectangular chart of the simulated L1 elevation gain pattern of the horizon nulling quadrifilar helix antenna associated with FIG. 2A.
Figure 2A:
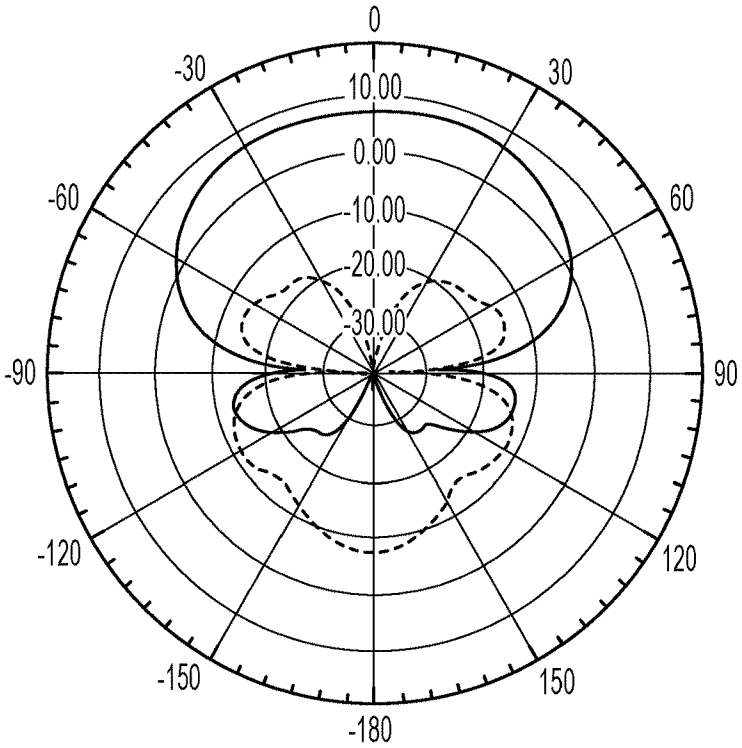
FIG. 2A is a polar chart of the simulated L1 elevation gain pattern of a horizon nulling quadrifilar helix antenna, according to some embodiments.

FIGS. 2A and 2B show the simulated elevation gain pattern of the modeled antenna. The RHCP gain pattern is shown with the solid line, and the LHCP gain pattern is shown with the dashed line. FIG. 2A is a polar chart, while FIG. 2B is a rectangular chart with the same information. As seen in the low gain values of the RHCP gain pattern around +/−90° from zenith, the modeled antenna has a null at the horizon. The LHCP gain pattern also has a null at the horizon. As illustrated in FIG. 2B, the modeled antenna has a 102 degree half-power beam width.

Figure 2D:
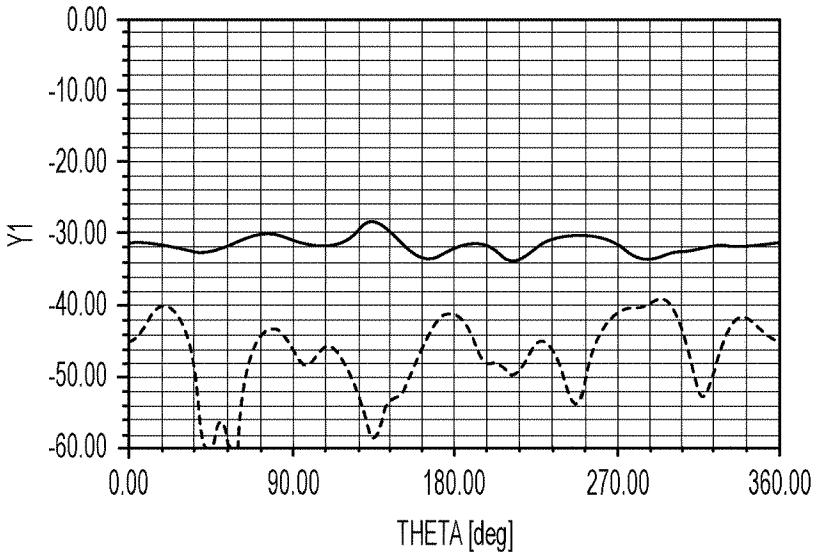
FIG. 2D is a rectangular chart of the simulated L1 azimuth zenith to horizon ratio pattern of the horizon nulling quadrifilar helix antenna associated with FIG. 2A.
Figure 2C:
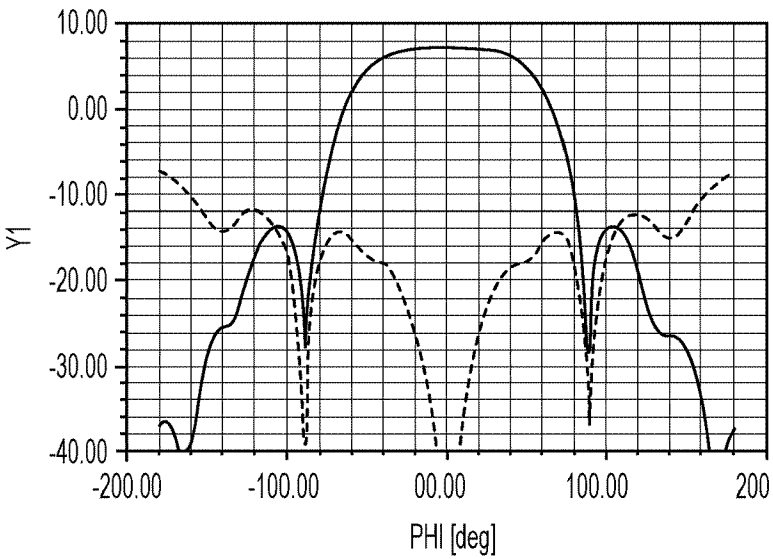
FIG. 2C is a polar chart of the simulated L1 azimuth zenith to horizon ratio pattern of the horizon nulling quadrifilar helix antenna associated with FIG. 2A.
Figure 2E:
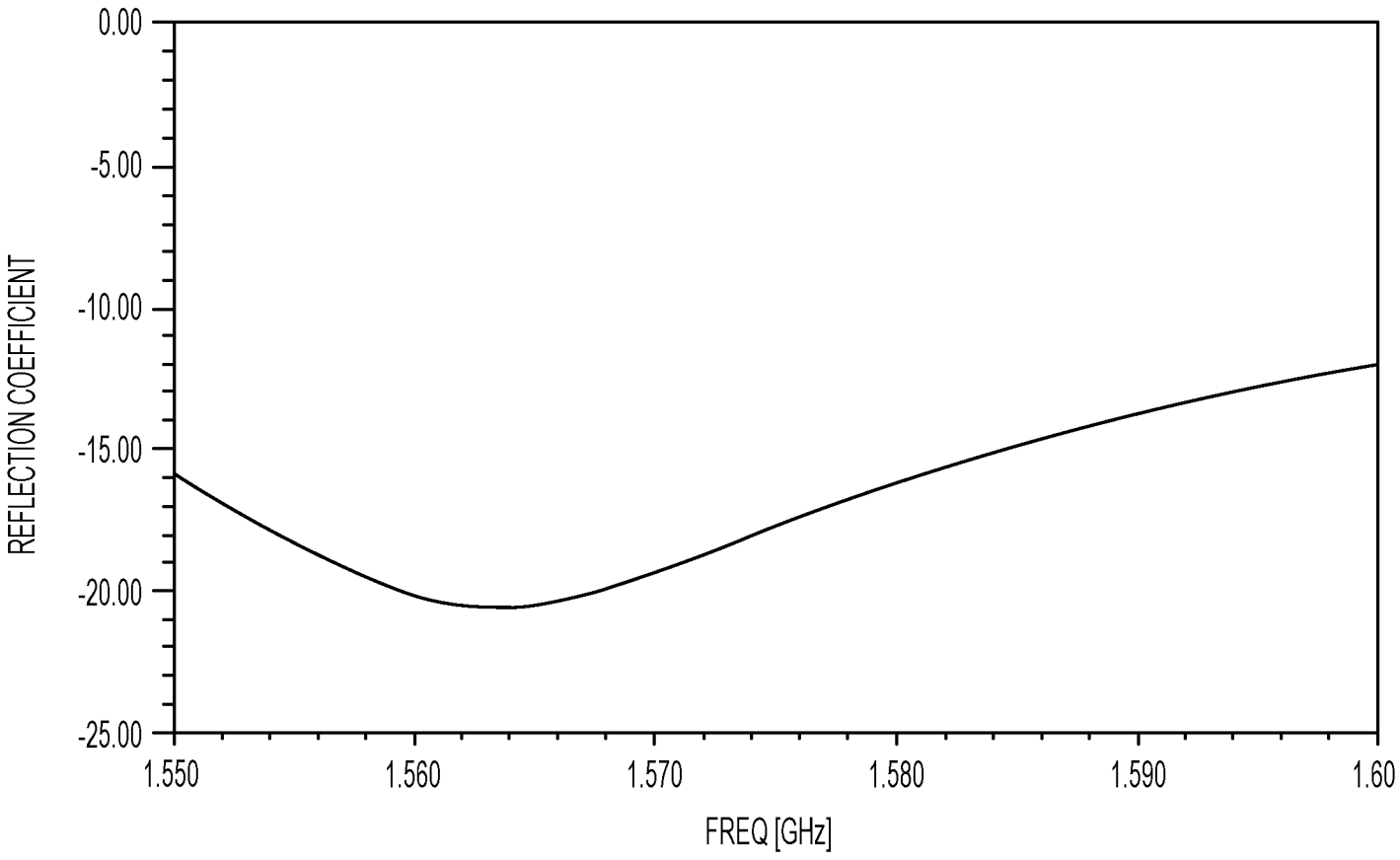
FIG. 2E is the simulated L1 reflection coefficient of the horizon nulling quadrifilar helix antenna associated with FIG. 2A.

FIGS. 2C and 2D show the simulated azimuth gain pattern of the modeled antenna. FIG. 2C is a polar chart while FIG. 2D is a rectangular chart with the same information. The RHCP zenith-to-horizon ratio is better than 30 dB, and the LHCP zenith-to-horizon ratio is better than 40 dB. FIG. 2E illustrates that the modeled antenna has a good impedance match (less than −10 dB) over the entire L1 GPS band.

Experimental Horizon Nulling Antenna

Figure 3A:
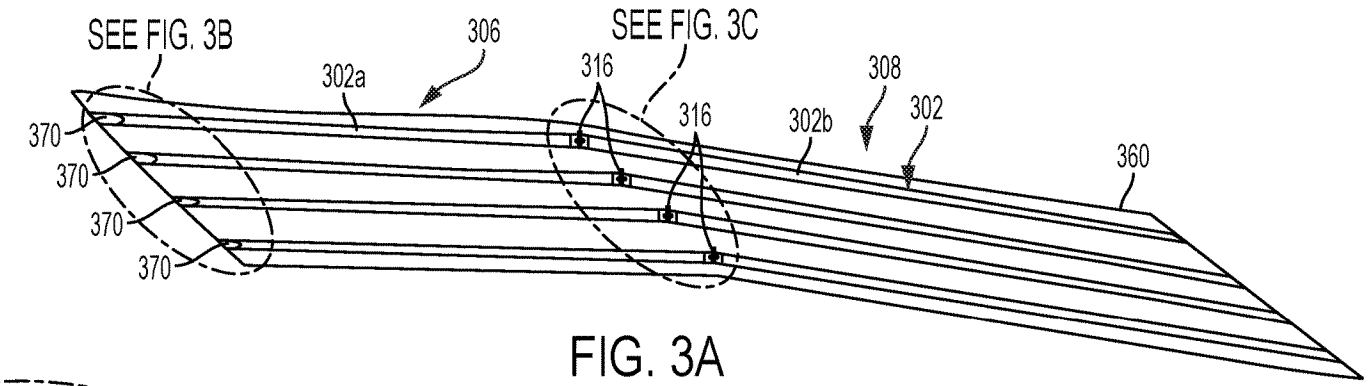
FIG. 3A illustrates a flexible printed circuit board with radiating elements and reactive elements for shaping into a horizon nulling helix antenna, according to some embodiments.
Figure 3C:
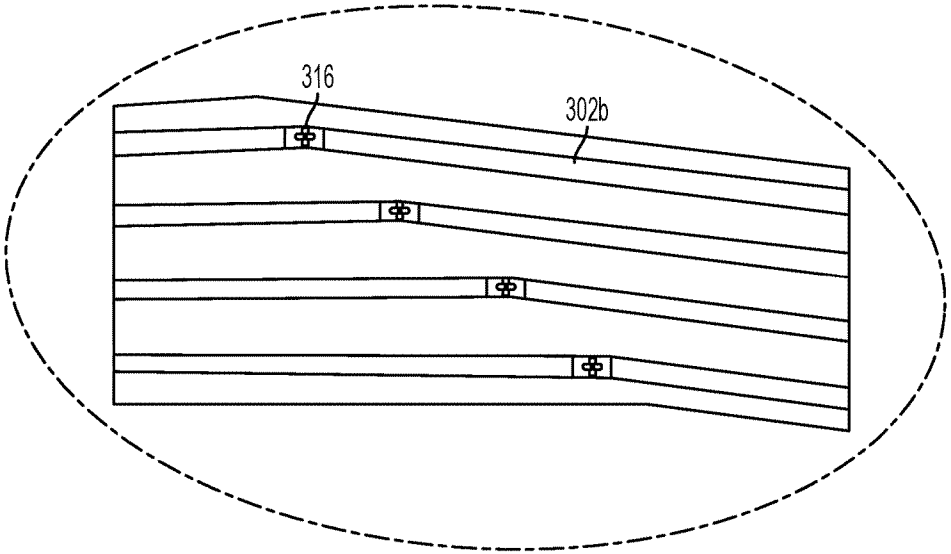
FIG. 3C is an enlarged view of the middle of the flexible printed circuit board of FIG. 3A showing the surface mount inductors.
Figure 3B:
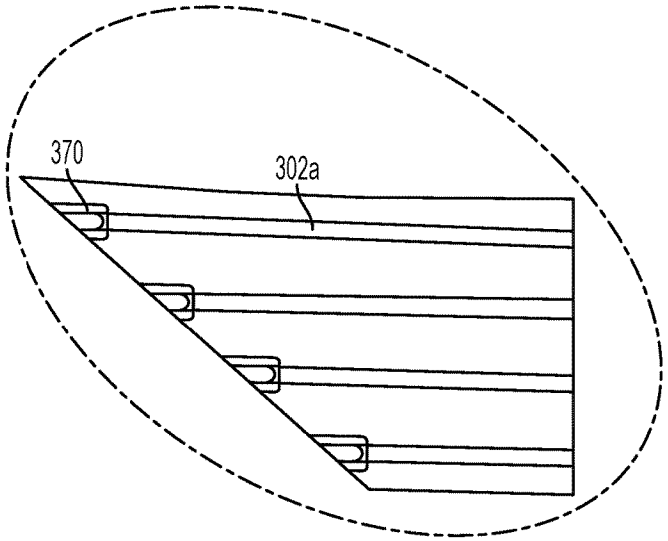
FIG. 3B is an enlarged view of the base of the flexible printed circuit board of FIG. 3A showing the feed points.

FIGS. 3A-3E illustrate a method of making a horizon nulling quadrifilar helix antenna 300, according to one embodiment. In FIG. 3A, the four arms 302 of the quadrifilar helix antenna 300 are disposed in a strip of flexible printed circuit board (PCB) 360. Each arm 302 is formed from a first strip 302*a* of conductive material joined to a second strip 302*b* of conductive material by a surface mount inductor 316. The group of first conductive strips 302*a* forms the lower section 306 of the antenna while the group of second conductive strips 302*b* forms the upper section 308 of the antenna. The arms 302 are evenly spaced and uniform.

Solder points 370 are placed at the start of the first conductive strips 302*a* for connecting to feed connectors of a feed network. The solder points 370 are shown enlarged in FIG. 3B. The ends of the arms terminate in an electrically open termination. The lower end of the strip of flexible PCB 360 is configured at an angle relative to the first conductive strips as dictated by the desired helical pitch. In this embodiment, the upper section 308 of the antenna has a different configuration than the lower section 306 of the antenna to account for the relative proximity to the ground plane, as discussed above. As such, the pitch of the upper section is lower than that of the lower section. The second conductive strips are angled relative to the first conductive strips to reduce the pitch when wound. The connection between the first and second conductive strips and the surface mount inductor 316 is shown enlarged in FIG. 3C.

Figure 3D:
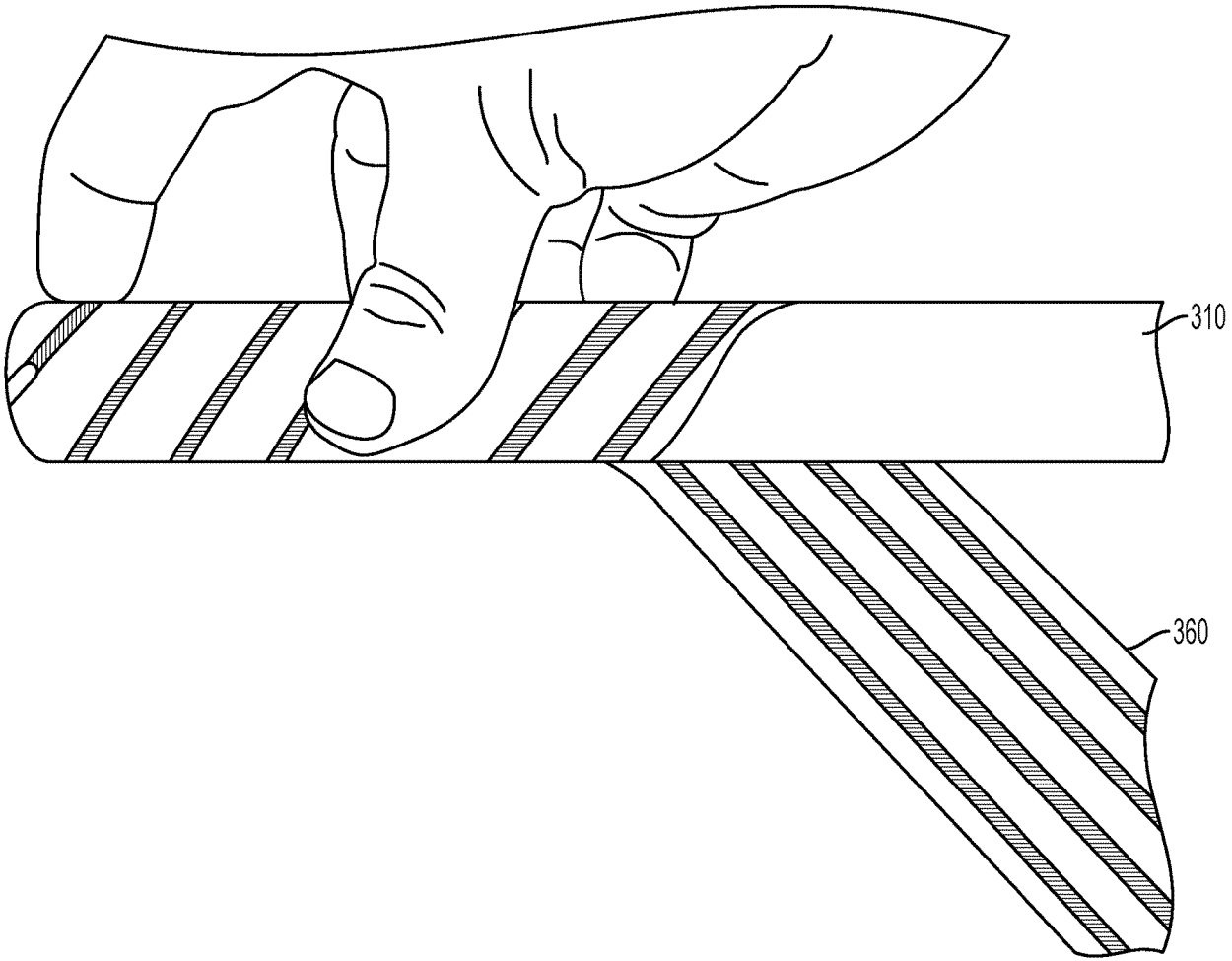
FIG. 3D illustrates the wrapping of the flexible printed circuit board of FIG. 3A around a cylindrical core for forming the helix antenna.

As shown in FIG. 3D, the flexible PCB 360 is wound around a mandrel, such as a Styrofoam cylinder 310. After winding, the flexible PCB 360 can be fixed in the helical shape, for example, by wrapping the wound flexible PCB 360 with tape, such as Kapton tape. The Styrofoam cylinder 310 or other mandrel can be removed or can remain depending on the desired characteristics of the antenna and on the ability of the flexible PCB 360 to hold the cylindrical shape.

Figure 3E:
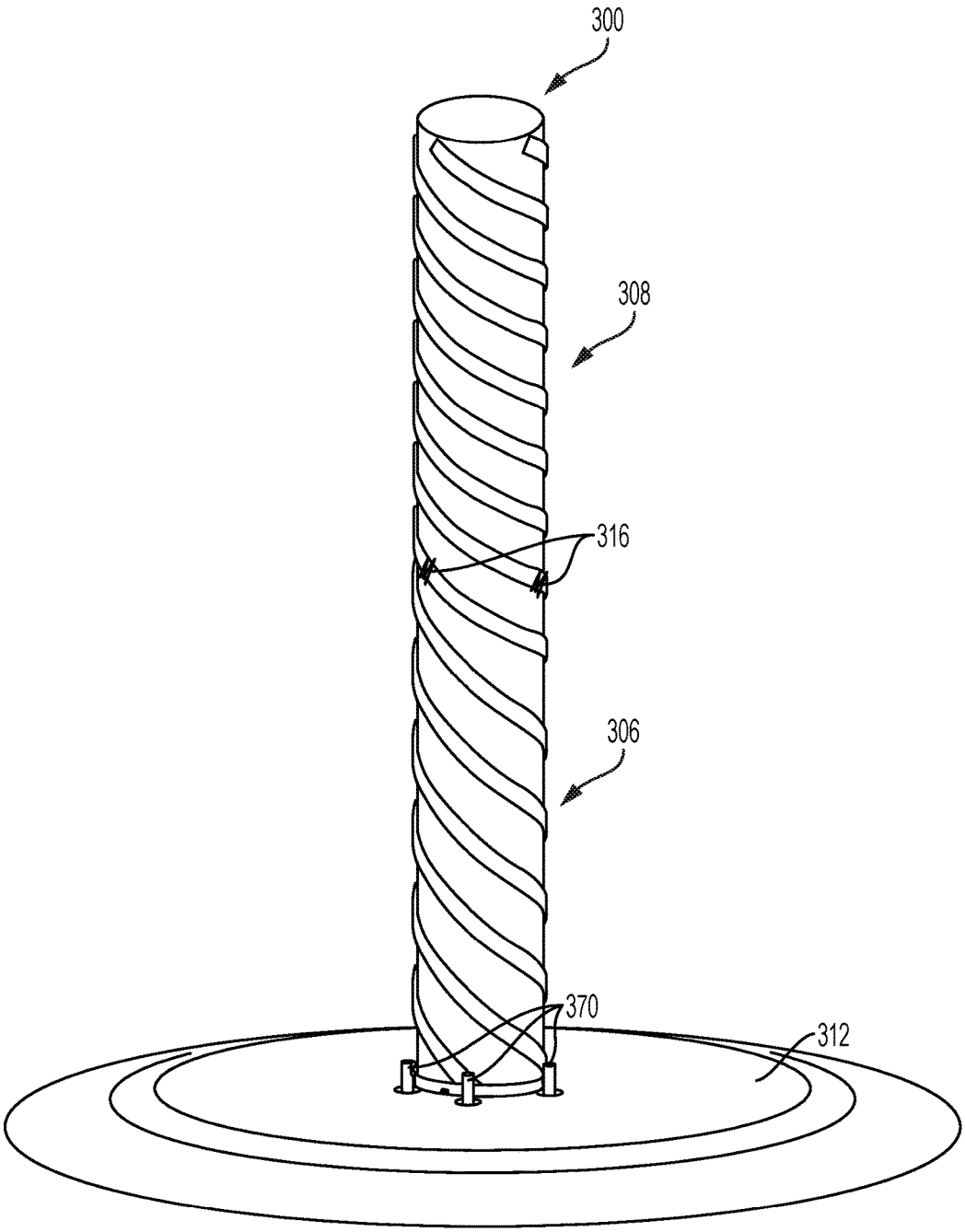
FIG. 3E illustrates a horizon nulling quadrifilar helix antenna formed from the flexible printed circuit board of FIG. 3A.

FIG. 3E shows the helix antenna attached to a metal plate 312 that serves as the ground plane. Signal lines of four connectors for connecting to a feed network extend through the plate 312 and are soldered to each of the four solder points 370 of the arms 302. The solder points 370 and signal lines of the connectors are electrically isolated from the metal plate 312. The ground lines of the four connectors are electrically connected to the plate 312.

Figure 3F:
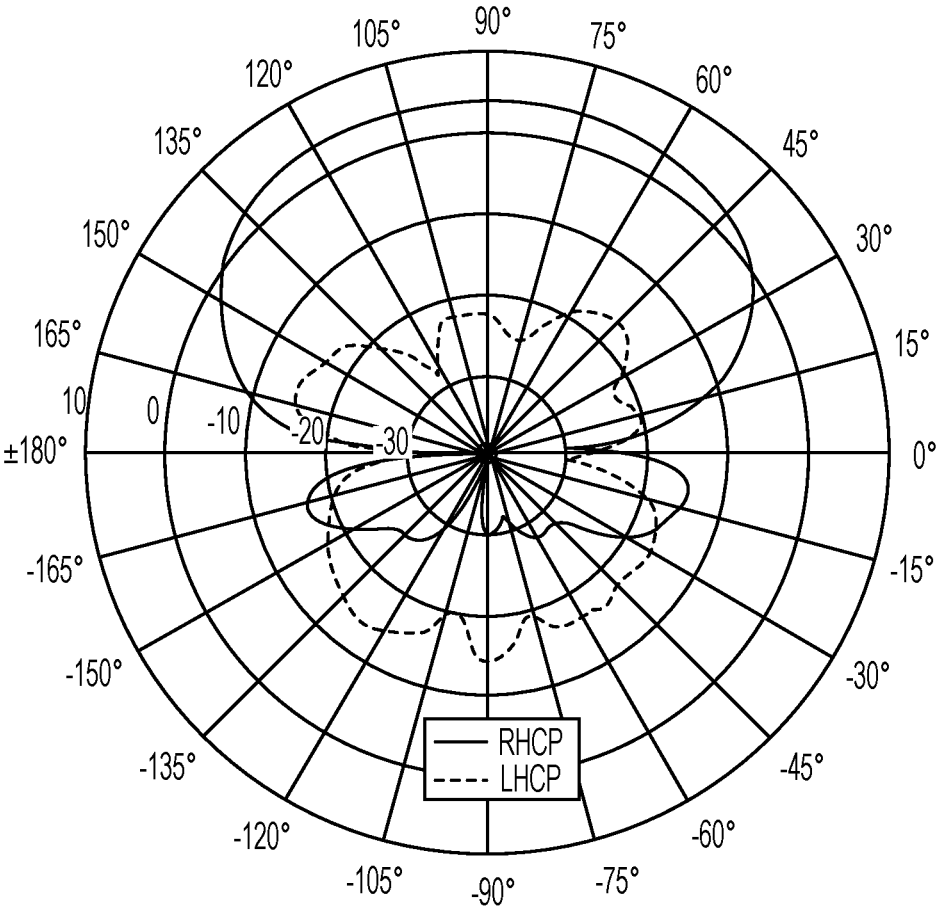
FIG. 3F is a polar chart of the L1 elevation gain pattern of the horizon nulling quadrifilar helix antenna of FIG. 3E.

FIG. 3F shows the performance of the antenna 300 of FIGS. 3A-3D. Antenna 300 was tested in an anechoic chamber with a Nearfield Systems Inc. (NSI) spherical near-field measurement system. The measurement system was calibrated prior to taking the antenna measurements. Commercial hybrid combiners were used to drive the four arms 302 in quadrature. The gain pattern measurements shown in FIG. 3F are at the GPS L1 frequency. As with the simulated antenna performance shown in FIG. 2A, the gain pattern of FIG. 3F shows a gain null at the horizon for both RHCP and LHCP. This illustrates the exceptional nulling of this antenna to incident waves of all polarizations, including vertical linear, horizontal linear, and LHCP.

Decoupled Concentric Helix Antenna

Described below are decoupled concentric helix antennas, according to an aspect of the invention. According to some embodiments, a dual-band decoupled concentric helix antenna includes two helices nested one inside the other. The two helices are configured to operate in different frequency bands, such as in the L1 and L2 GPS frequency bands. Trap circuits are included in the outer helix to prevent excitation of the outer helix at the resonant frequency of the inner helix, which minimizes or eliminates disruption of the radiation pattern of the inner helix by the outer helix. This allows dual-band operation in a compact, low-cost form.

Figure 4:
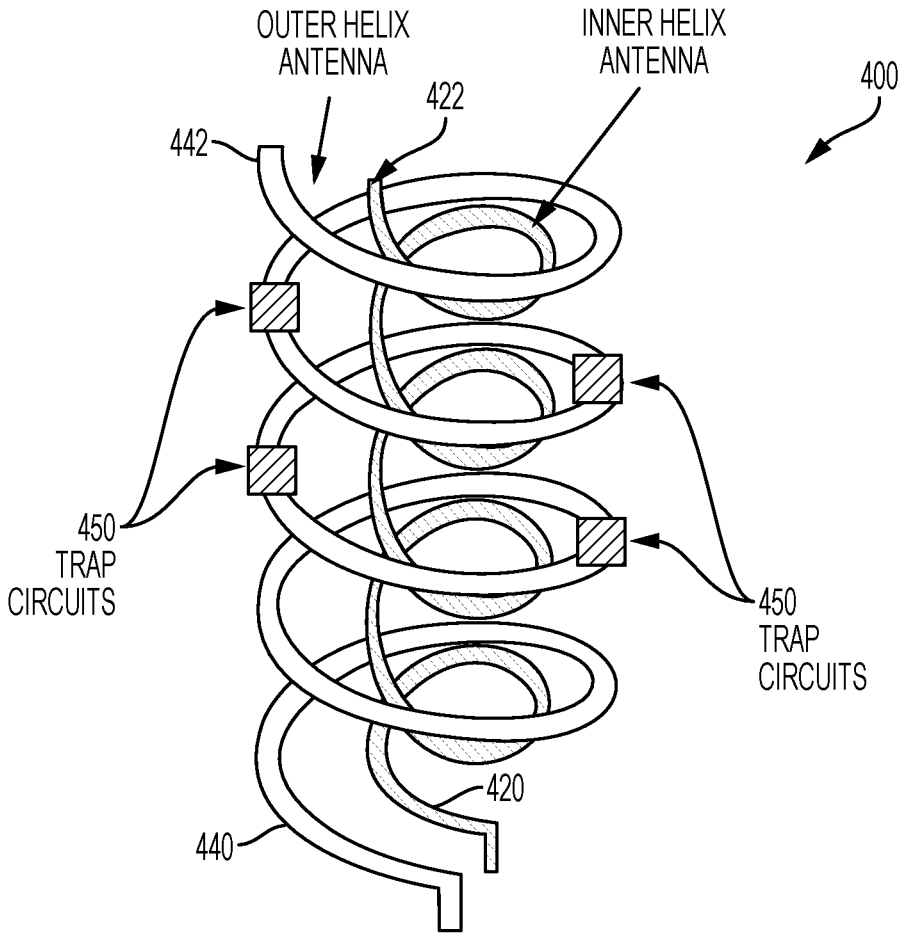
FIG. 4 is a an illustration of a dual-band concentric monofilar helix antenna, according to some embodiments.

FIG. 4 shows a simplified monofilar helix antenna 400 that illustrates the principles of the decoupled concentric helix antenna design according to some embodiments. The inner helix 420 is tuned for operating in a first frequency band, and the outer helix 440 is tuned for operating in a second frequency band that is different from the first band such that antenna 400 is a dual-band antenna. One or more trap circuits 450, such as parallel inductive-capacitive (LC) circuits, are disposed along the length of the arm 442 of the outer helix 440. The trap circuits 450 are configured to resonate near the resonant frequency of the inner helix 420. As such, the trap circuits 450 suppress current flow in the arms 442 of the outer helix 440 at the resonant frequency of the inner helix 420. Suppressing the current in the larger helix decouples the concentric helices and preserves the beam pattern of each individual helix.

At the resonant frequency of the trap circuit, the trap circuit has high impedance, which prevents current from flowing through it. Since the trap circuits are configured for resonance at the operating frequency of the inner helix, when the inner helix antenna is radiating, the tank circuits are resonant. The high impedance of the tank circuits at their resonant frequency prevents current flow, meaning the current does not flow along the entire length of the outside helix. The practical effect is that, at the resonate frequency of the inside helix, the outside helix is broken up into sections (e.g., sections of an arm between the trap circuits in the arm). In breaking up the outer helix, the outer helix has reduced coupling with the inner helix. Since there is little or no coupling, the inner helix's gain pattern is preserved.

The resonant frequency of the outer helix is far enough away in frequency from the resonance frequency of the trap circuits that the impedance of the trap circuits is low. The effect of this is that the trap circuit appears as a simple conductor bridging the adjacent segments. The current can flow through, and the outer helix resonates with the expected gain pattern.

As stated above, the trap circuit can be a parallel LC circuit, which may be realized, for example, using surface mount components or printed components. According to some embodiments trap circuits may include split-ring resonators, complementary split-ring resonators, lumped elements, distributed elements, or any combination thereof.

Figure 5:
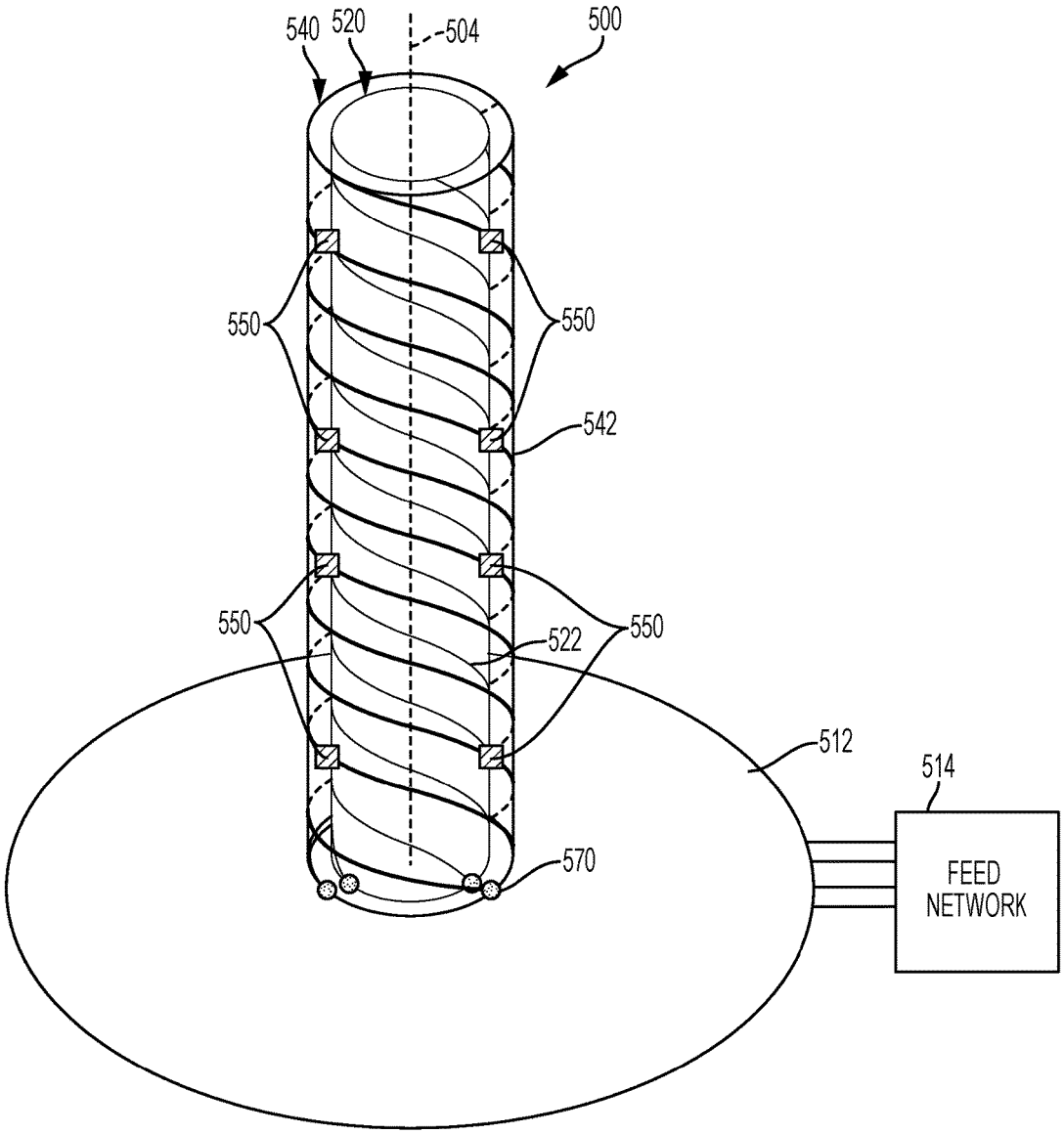
FIG. 5 is an illustration of a dual-band concentric quadrifilar helix antenna, according to some embodiments.

FIG. 5 illustrates an antenna 500, according to one embodiment. Antenna 500 includes an inner quadrifilar helix antenna 520 that is configured to operate in a first frequency band positioned inside of an outer quadrifilar helix antenna 540 that is configured to operate in a first frequency band that is less than the first band. Inner helix antenna 520 includes four radiating element arms 522 extending helically about a central longitudinal axis 504, forming a quadrifilar helix antenna. Arms 522 extend at a first distance from axis 504, which in this embodiment is a diameter of the circular cross section of inner helix 520. In other embodiments, the inner helix antenna may have a non-circular cross section, such as a polygonal cross section, and the first distance is a diameter of a circle circumscribing the polygon. The arms extend from a lower end where they can be connected to a feed network 514 and terminate at an upper end in an electrically open configuration. The arms are preferably left-hand wound for right-hand circular polarization, but they may be right-hand wound for left-hand circular polarization.

Outer helix antenna 540 includes four arms 542 extending helically about the central longitudinal axis 504, forming a quadrifilar helix antenna. Arms 542 extend at a second distance from axis 504, which in this embodiment is a diameter of the circular cross section of outer helix 540. The second distance is greater than the first distance such that the outer helix antennas 540 surrounds (i.e., extends about) the inner helix antenna 520. In other embodiments, the inner helix antenna may have a non-circular cross section, such as a polygonal cross section, and the second distance is a diameter of a circle circumscribing the polygon. The arms extend from the lower end where they can be connected to the feed network 514 (e.g., through feed points 570) and terminate at the upper end in an electrically open configuration. The arms are preferably left-hand wound for right-hand circular polarization.

The inner and outer helices are tuned for resonant operation in different frequency bands. As such, helix antenna 500 is a dual-band antenna. For example, according to one embodiment, inner helix 520 is configured to operate in the L1 GPS frequency band and outer helix 540 is configured to operate in the L2 GPS frequency band. According to some embodiments, the antenna is configured for resonant operation in at least two different predefined frequency bands. The predefined frequency bands may be a band defined by a frequency allocation authority. According to some embodiments, the frequency band of the inner helix and the frequency band of the outer helix do not overlap. In some embodiments, the respective frequency bands do overlap, but the center frequency of one band is not within the other band.

One or more trap circuits 550 are distributed on each of the outer helix antenna arms 542. The trap circuits 550 may include one or more surface mount inductors in parallel with one or more surface mount capacitors. The trap circuits 550 are electrically connected in series with respective segments of a helix arm.

Figure 6B:
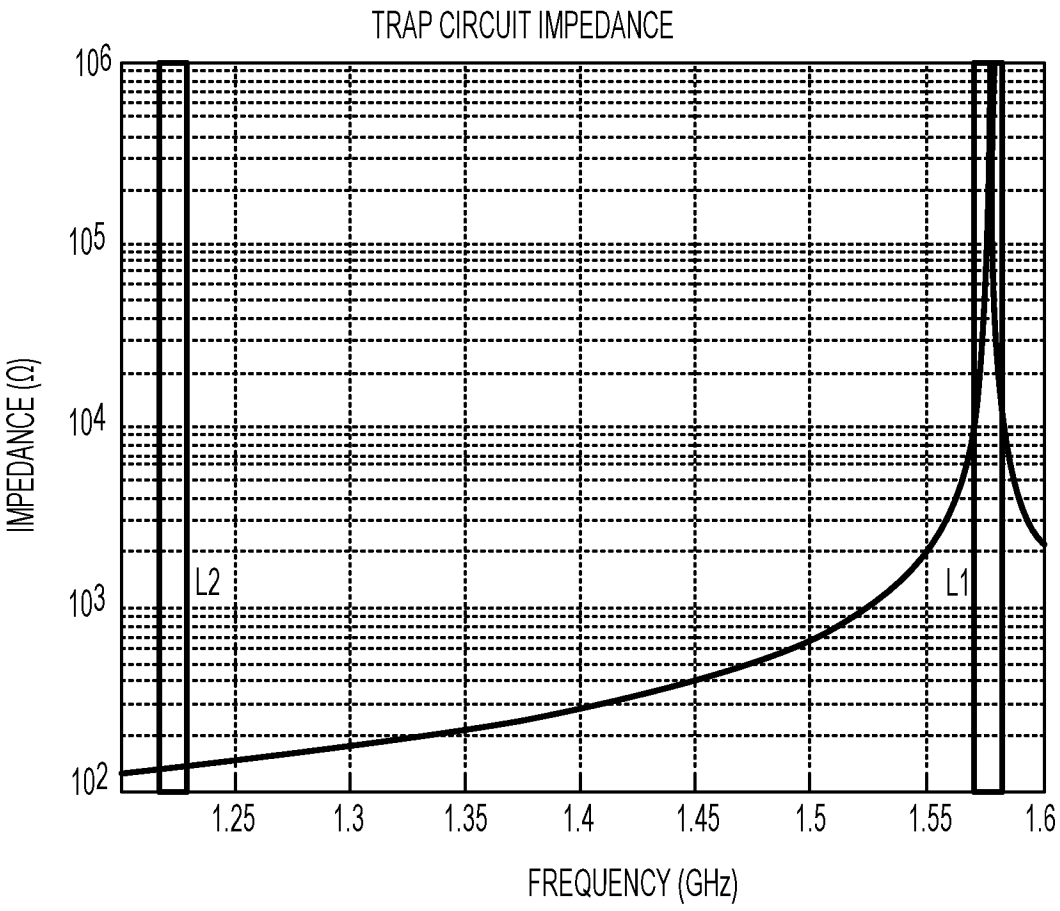
FIG. 6B is a chart of the impedance as a function of frequency of the trap circuit of FIG. 6A, according to some embodiments.
Figure 6A:
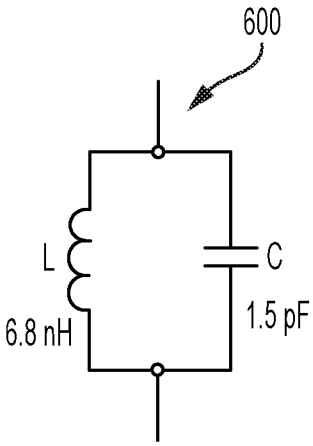
FIG. 6A is a circuit diagram of a trap circuit for a concentric helix antenna, according to some embodiments.

A circuit diagram of a trap circuit 600, according to one embodiment, is shown in FIG. 6A. In this embodiment, the trap circuit 600 is configured for an L1/L2 GPS application such that the trap circuit has high impedance at the L1 frequency band, which is centered at 1575.42 MHz, and relatively low impedance at the L2 frequency band, which is centered at 1227.60 MHz. The inductor 602 value may be 6.8 nH, and the capacitor 604 may be a 1.6 pF capacitor. The impedance of trap circuit 600 is shown as a function of frequency in FIG. 6B. It can be seen that the impedance becomes very high at the L1 frequency, while it is low at the L2 frequency. As such, placement of one or more trap circuits 600 in the arms of the outer L2 helix can prevent current from flowing in the outer L2 helix in response to a signal in the L1 frequency band, while not preventing current from flowing in response to a signal in the L2 frequency band.

In some embodiments, a trap circuit may be configured such that the resonant frequency of the trap circuit is outside of the operating band of the inner helix while still maintaining high impedance within the operating band of the inner helix. This can reduce phase noise. This may be important, for example, in embodiments for GPS application in which the phase is important. For example, the resonant frequency of the trap circuits may be just slightly outside of the L1 operating band of the inner helix. In this case, the impedance may still be very high, but little or no phase noise may be introduced. In some embodiments in which phase noise is not important, the trap circuits are configured with a resonant frequency that is within the operating frequency band of the inner helix.

According to some embodiments, a trap circuit has a first impedance at the resonant frequency of the inner helix and a second impedance at the resonant frequency of the outer helix, in which the first impedance is higher than the second impedance. The first impedance may be at least one order of magnitude greater than the second impedance, at least two orders of magnitude greater than the second impedance, or at least three orders of magnitude greater than the second impedance. In some embodiments, a trap circuit has a maximum impedance that is within an operating frequency band of the inner helix (e.g., within the L1, L2, or L5 GPS frequency band). In some embodiments, a trap circuit has a peak impedance that is outside of an operating frequency band of the inner helix, but the impedance within the operating frequency band is sufficient to decouple in the outer helix from the inner helix (or inner helices for antennas with greater than two bands).

The number and location of trap circuits on the outer helix may vary and may depend on the desired characteristics of a particular antenna application. For example, the number and location of the trap circuits may depend on design parameters such as the operating bandwidth, impedance, height, arm length, diameter, etc. of the antenna. According to some embodiments, each arm includes a single trap circuit, for example, disposed midway up the arm. In some embodiments, each arm includes multiple trap circuits distributed uniformly along the arm in order to divide the arm into segments of equal length. In some embodiments, the number of trap circuits per arm is two or more, three or more, four or more, five or more, or ten or more. In some embodiments, the number and locations of the trap circuits are the same from one arm to the next. In some embodiments, the number and location of trap circuits may be based on the number of turns. For example, there may be one or more trap circuits per turn. In some embodiments, there may be one or more trap circuits per every two turns, per every three turns, per every four turns, etc.

The cross sections of both the inner and outer helices of antenna 500 are circular and uniform along the longitudinal axis. Other embodiments may include noncircular cross sections, such as triangular, rectangular, or hexagonal cross sections. The diameter and pitches of the helices may be selected based on the desired impedances and operating bandwidths of the antenna.

A ground plane 512 may be located at the lower end of the antenna 500 to reflect energy toward the upper end to minimize back lobes. In some embodiments, connectors are provided at the ground plane for connection to feed points at the base of the arms. The signal line of a connector may be electrically connected to the feed point of an arm and the ground line of the connector may be connected to the ground plane. The arms are excited through the feed points with feed signals in phase quadrature to obtain circular polarization. The choice of specific feed network configuration depend on design factors known to those skilled in the art, such as manufacturability, reliability, cost, etc.

In some embodiments, the ground plane may be formed as a conducting film, such as a metal film (e.g., aluminum, copper, gold, silver, etc.) deposited on a substrate. In some embodiments, the ground plane is formed of sheet metal or machined metal and may provide structural support for the antenna. In some embodiments, a ground plane is omitted.

The arms may be formed from any conductive material, such as copper, aluminum, gold, etc. The arms may be in the form of wire, strips, traces, etc. According to some embodiments, the arms are sufficiently rigid that they are self-supporting when formed into helices. In some embodiments, the arms are embedded within a substrate, such as a flexible printed circuit board, that is shaped such that the arms form helices. In some embodiments, the arms may be supported by a support structure, such as a cylindrical support structure for the inner helix and a ring support structure for the outer helix. For example, a Styrofoam cylinder may be used to provide structural support to the arms of the inner helix, and a Styrofoam ring may be used to provide structural support to the arms of the outer helix.

Although antenna 500 includes four arms for each of the inner and outer helices, other embodiments may include any number of arms, such as one, two, three, or eight without departing from the principals described above. In some embodiments, the arms have an electrically open termination at the upper end. In other embodiments, one or more arms are electrically connected to one or more other arms, for example, for impedance matching.

The configuration of the antenna may be selected based on the desired properties for the specific design application (e.g., operating bandwidth, feed network, size, power, weight, cost, etc.) according to known methods. Configurable parameters include helix diameter, number of turns, antenna height, radiating element length, etc. According to some embodiments, one or more parameters are selected as a function of the operating wavelength. For example, the radiating element length (e.g., length of the radiating element from the feed point to the termination point) may be less than 3.0λ, less than 2.0λ, less than 1.5λ, less than 1.0λ, less than 0.75λ, less than 0.5λ, or less than 0.25λ. According to some embodiments, the length may be greater than 0.1λ, greater than 0.25λ, greater than 0.5λ, greater than 0.75λ, greater than 1.0λ, greater than 1.25λ, greater than 1.5λ, or greater than 2.0λ.

Similarly, the height of the antenna may be selected as a function of the operating wavelength. According to some embodiments, the height of the antenna may be less than 3.0λ, less than 2.0λ, less than 1.5λ, less than 1.2λ, less than 1.0λ, less than 0.75λ, less than 0.5λ, or less than 0.25λ. According to some embodiments, the height of a section may be greater than 0.1λ, greater than 0.25λ, greater than 0.5λ, greater than 0.75λ, greater than 0.8λ, greater than 1.0λ, greater than 1.25λ, greater than 1.5λ, or greater than 2.0λ, In some embodiments, the height of a section is preferably about 0.5λ.

In some embodiments, the number of turns completed by the arms of the inner helix and/or the arms of the outer helix may be less than or equal to one, less than or equal to two, less than or equal to three, or less than or equal to four. In some embodiments, the number of turns completed by the arms of the inner helix and/or the arms of the outer helix may be greater than or equal to one-half, greater than or equal to three-quarters, greater than or equal to one and a quart, or greater than or equal to one and a half.

As stated above, antenna 500 is a dual-band antenna, with the inner helix being configured to operate in a first band and the outer helix being configured to operate in a second band.

The principles described above can be used to configure helix antennas with more than two bands. For example, three helices can be used for a tri-band antenna (e.g., to operate at the L1, L2, and L5 GPS bands). For a tri-band antenna, trap circuits in the middle helix are configured with high impedance at the operating frequency of the innermost helix, and trap circuits in the outermost helix are configured with high impedance at the operating frequencies of both the middle helix and the innermost helix. For example, the outermost helix may include first trap circuits configured for impedance at the operating frequency of the innermost helix and second trap circuits configured for high impedance at the operating frequency of the middle helix. In this way, multi-band antennas may be configured to operate at any number of frequency bands.

Horizon Nulling Decoupled Concentric Helix Antenna

According to some embodiments, a horizon nulling decoupled concentric helix antenna can be configured by combining the features of concentric helix antennas with the features of horizon nulling antennas described above. Antennas, according to some embodiments, can include a null in the gain pattern around the horizon for each of multiple bands. For example, a dual-band GPS antenna can be configured to operate at the L1 and L2 bands with a null in the gain pattern at the horizon (or in some other direction) for each of the L1 and L2 bands.

Figure 7:
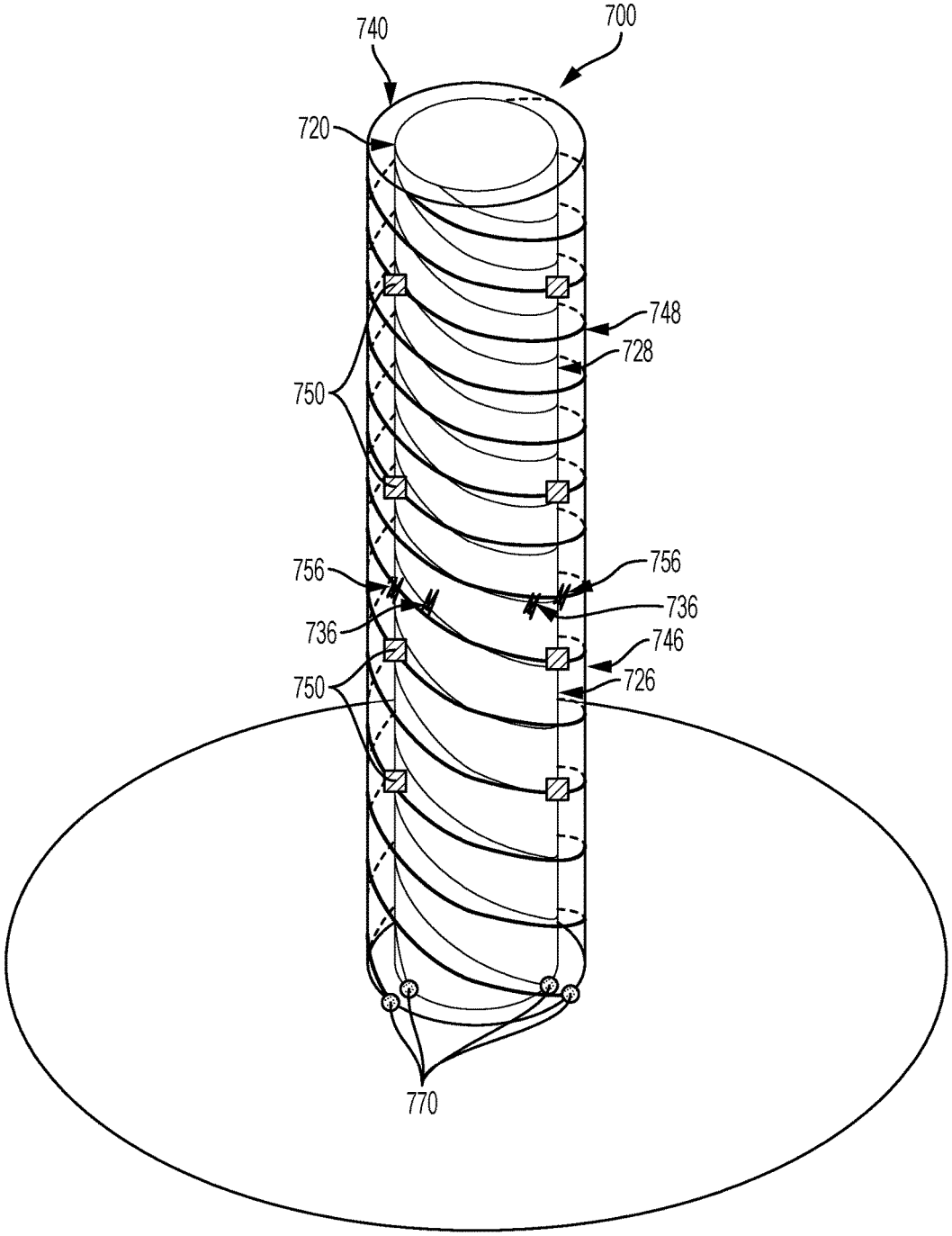
FIG. 7 is an illustration of a dual-band horizon nulling concentric quadrifilar helix antenna, according to some embodiments.

FIG. 7 illustrates a horizon nulling decoupled concentric quadrifilar helix antenna 700, according to one embodiment. Antenna 700 is a dual-band antenna with an inner helix 720 that is configured to operate in a first frequency band and an outer helix 740 that is configured to operate in a second frequency band that is lower in frequency than the first frequency band. Each of the inner and outer helices is divided into a lower section (726, 746) and an upper section (728, 748). The sections are electrically connected to one another by one or more reactive elements (736, 756) according to the principles discussed above.

Outer helix 740 includes trap circuits 750 in each arm 742 for preventing current flow in the outer helix at the operating frequency of inner helix 720 according to the principles described above. In the embodiment of antenna 700, the trap circuits 750 of the outer helix 740 are distinct from the reactive elements 756 of the outer helix 740. In other embodiments, one or more trap circuits are integrated with or serve as one or more reactive elements. Each arm 742 includes four trap circuits 750 that are irregularly spaced along the height of the outer helix 740. In some embodiments, the placement of the trap circuits is based on the location of maximum current density of the same antenna without the trap circuits. For example, an antenna with the same configuration as antenna 700 but without the trap circuits can be modeled or built and the current density can be simulated or measured. Based on the simulation or measurements, the locations of high current density can be determined. The trap circuits can then be located at those locations.

The construction of antenna 700 is similar to the construction of antenna 500 of FIG. 5. A ground plane 712 may be located at the lower end of the antenna 700 to reflect energy toward the upper end to minimize back lobes. In some embodiments, connectors are provided at the ground plane for connection to feed points 770 at the base of the arms. The signal line of a connector may be electrically connected to the feed point of an arm, and the ground line of the connector may be connected to the ground plane. The arms are excited through the feed points with feed signals in phase quadrature to obtain circular polarization.

In some embodiments, the ground plane may be formed as a conducting film, such as a metal film (e.g., aluminum, copper, gold, silver, etc.) deposited on a substrate. In some embodiments, the ground plane is formed of sheet metal or machined metal and may provide structural support for the antenna. In some embodiments, a ground plane is omitted.

In some embodiments, the inner helix may include one or more reactive elements for creating a gain null while the outer helix may not include any reactive elements for creating a gain null. In some embodiments, the inner helix may not include any reactive elements, while the outer helix includes reactive elements for creating a gain null. In some embodiments, reactive elements may not be needed on one or more of the inner and outer helix (or outer helices for three or more bands) to cause a relative shift in the waveforms of the upper and lower sections for nulling. For example, shifting sufficient to generate a null may result from a change in geometry from the lower section to the upper section.

FIGS. 8A-8D show the simulated performance of a modeled antenna with concentric L1 and L2 helices, according to one embodiment. The inner helix of the modeled antenna is configured to operate in the GPS L1 frequency band with a nominal operating frequency of 1575.42 MHz. The height of the modeled inner helix along the longitudinal axis from the ground plane to the termination point of the arms is about 200 mm and the diameter is about 26 mm. There are four arms, evenly spaced 90° apart, that are fed in quadrature. The ground plane is about 180 mm in diameter. The reactive elements are inductors with an inductance of 47 nH and are located at 100 mm along the longitudinal axis from the ground plane such that the lower and upper sections are of equal height (extent along the longitudinal axis).

The outer helix of the modeled antenna is configured to operate in the GPS L2 frequency band with a nominal operating frequency of 1227.60 MHz. The height of the modeled outer helix along the longitudinal axis from the ground plane to the termination point of the arms is about 190 mm, and the diameter is about 42 mm. There are four arms, evenly spaced 90° apart, that are fed in quadrature. The reactive elements are inductors with an inductance of 1 nH and are located about midway along the longitudinal axis from the ground plane such that the lower and upper sections are of substantially equal height (extent along the longitudinal axis). The trap circuits include a 6.5 nH inductor in parallel with a 1.5 pF capacitor.

Figures 1, 8A:
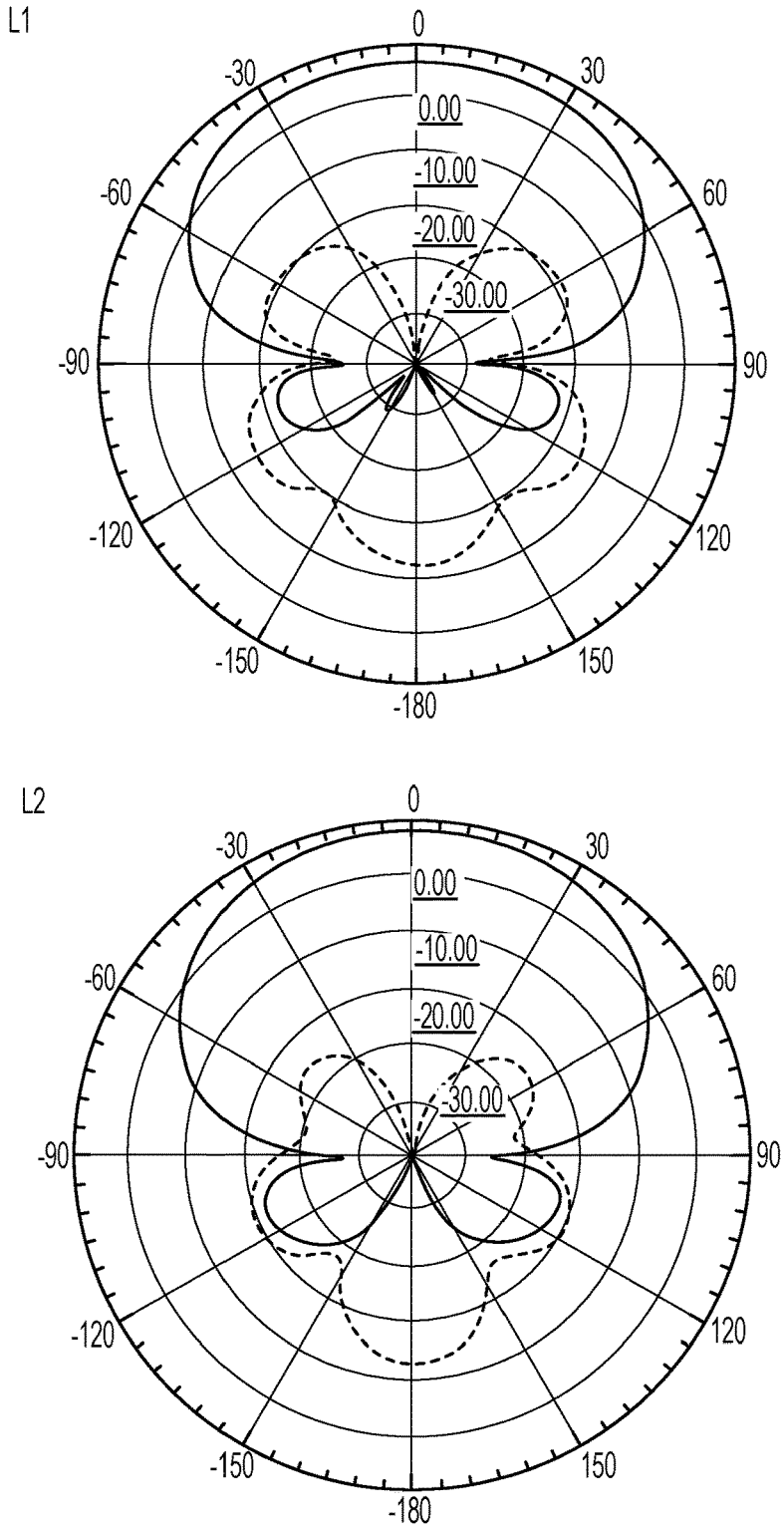
Figure 8A:
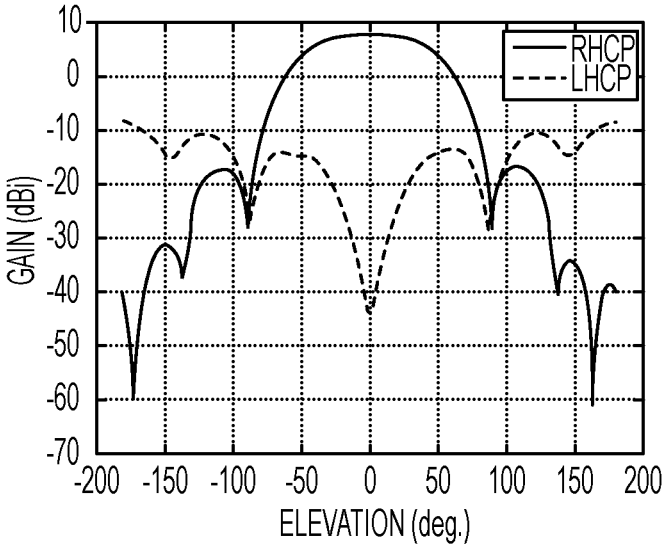
Figure 2:
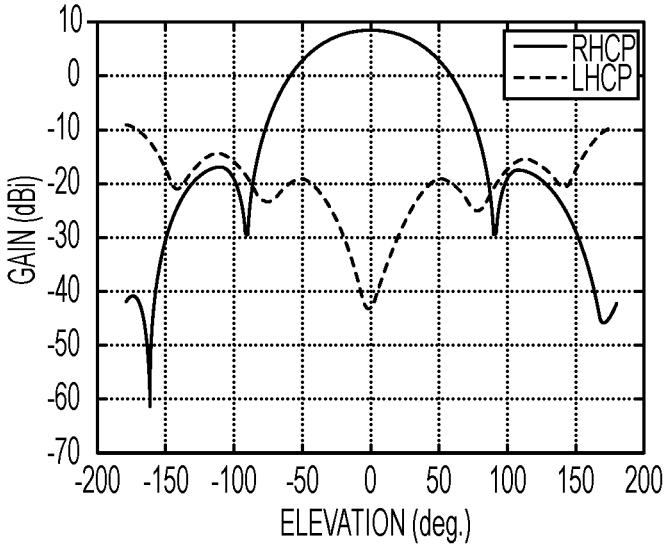

FIGS. 8A-1 is a polar plot illustrating the simulated elevation gain patterns of the modeled antenna for both the L1 and L2 frequency bands. FIG. 8A-2 is a rectangular plot with the same information. The RHCP gain patterns are shown in solid lines, and LHCP gain patterns are shown in dashed lines. The decoupling of the concentric helices preserves the shaped beam patterns for L 1 and L2. This can be seen by comparing the gain pattern of the modeled L 1 single-band antenna shown in FIG. 2A with the L1 gain pattern in FIG. 8A-1. The shape and magnitude of the gain pattern is substantially the same by virtue of the decoupling of the L2 helix from the L1 helix with the trap circuits. As shown in FIGS. 8A-1, 8A-2, the HPBW of the antenna at L1 is about 92°, and the HPBW of the antenna at L2 is about 80°, both of which are sufficient for GPS timing applications.

Figure 8B:
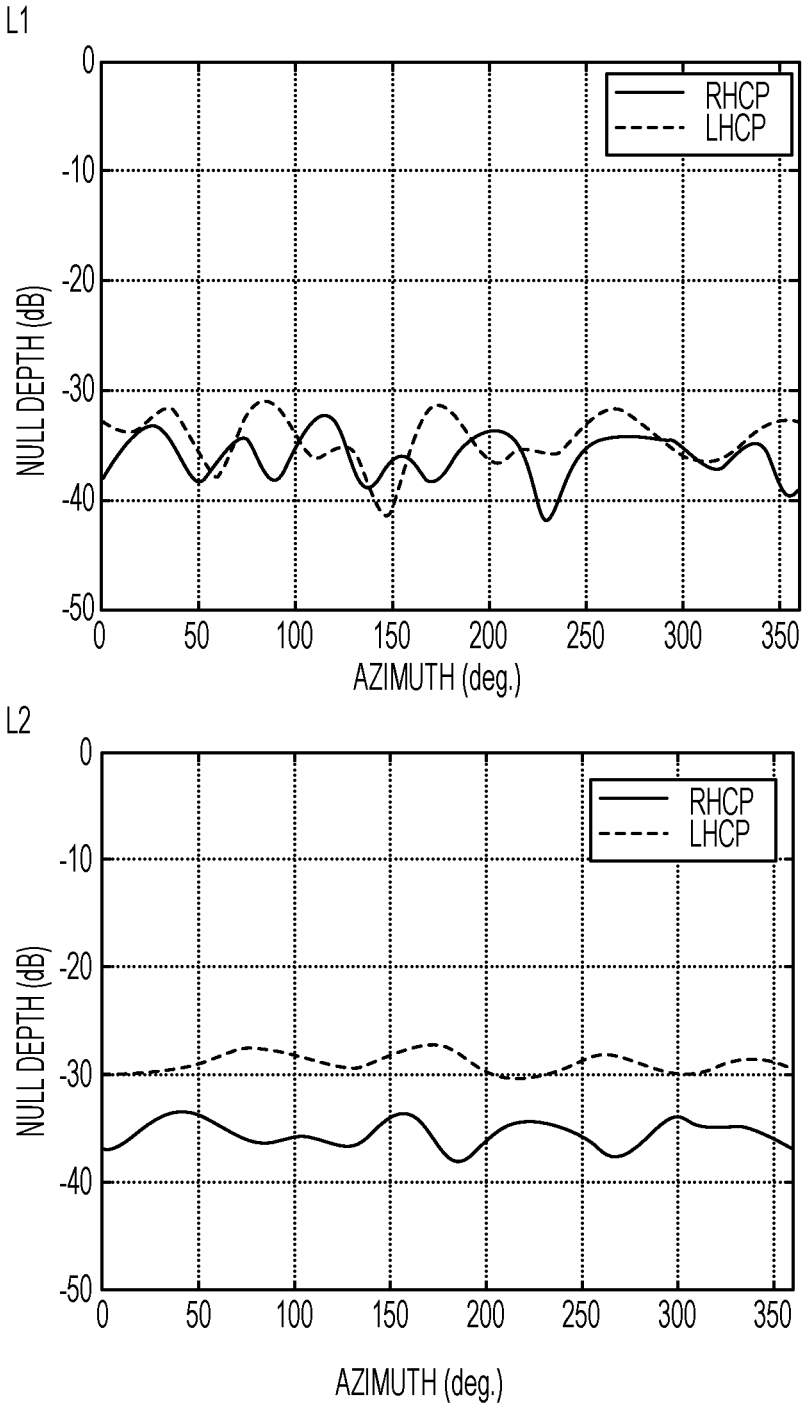
FIG. 8B includes charts of the simulated L1 and L2 zenith to horizon ratios around azimuth of the dual-band horizon nulling concentric quadrifilar helix antenna associated with FIGS. 8A-1, 8A-2.

FIG. 8B illustrates the zenith-to-horizon gain difference (null depth) over azimuth of the modeled antenna. These charts illustrate the anti jamming capability of the antenna. As illustrated in the top chart of FIG. 8B, both the L1 LHCP and RHCP gain difference between the gain at zenith and the gain at the horizon (+/−90° in elevation) is greater than −30 dB. As illustrated in the bottom chart of FIG. 8B, the L2 RHCP gain difference is also greater than −30 dB and the L2 LHCP gain difference is greater than −25 dB. Thus, both RHCP and LHCP signals received by the antenna from its horizon at L1 and at L2 are much weaker (if detected at all) relative to signals of the same power received by the antenna from its zenith. These charts indicate that a good null is achieved around the full azimuth of the antenna.

Figure 8C:
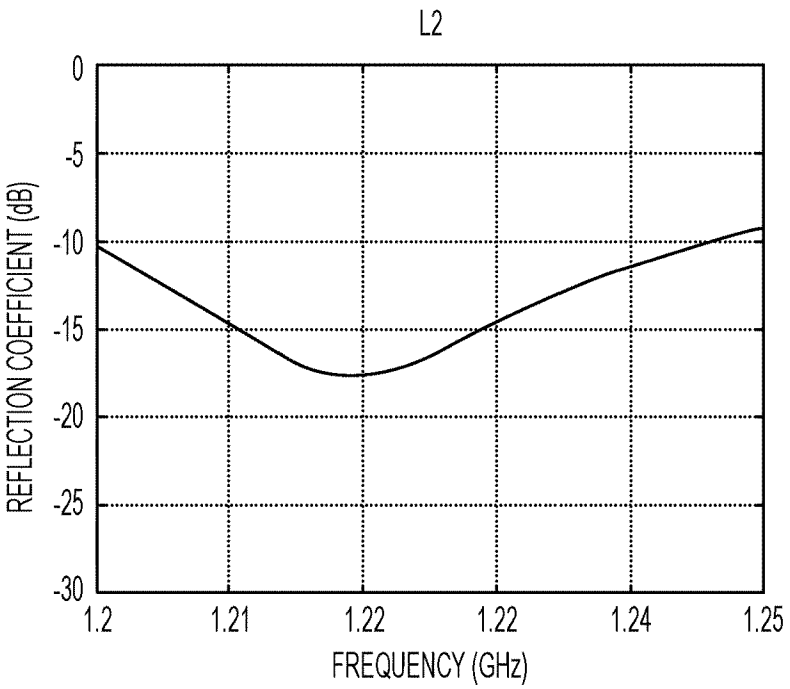
FIG. 8C illustrates simulated reflection coefficients for a modeled dual-band antenna at the L1 and L2 frequency bands of the dual-band horizon nulling concentric quadrifilar helix antenna associated with FIGS. 8A-1, 8A-2.
Figure 8C:
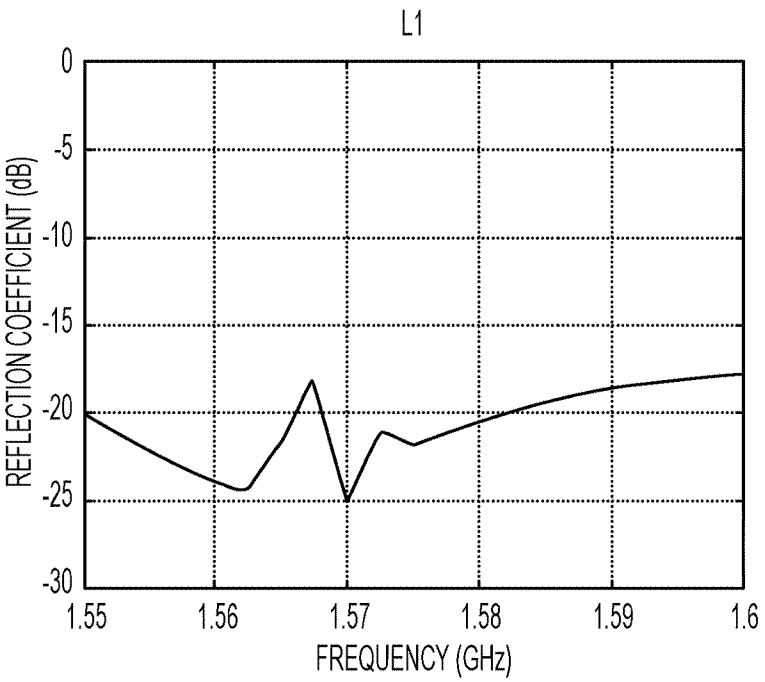
Figure 8D:
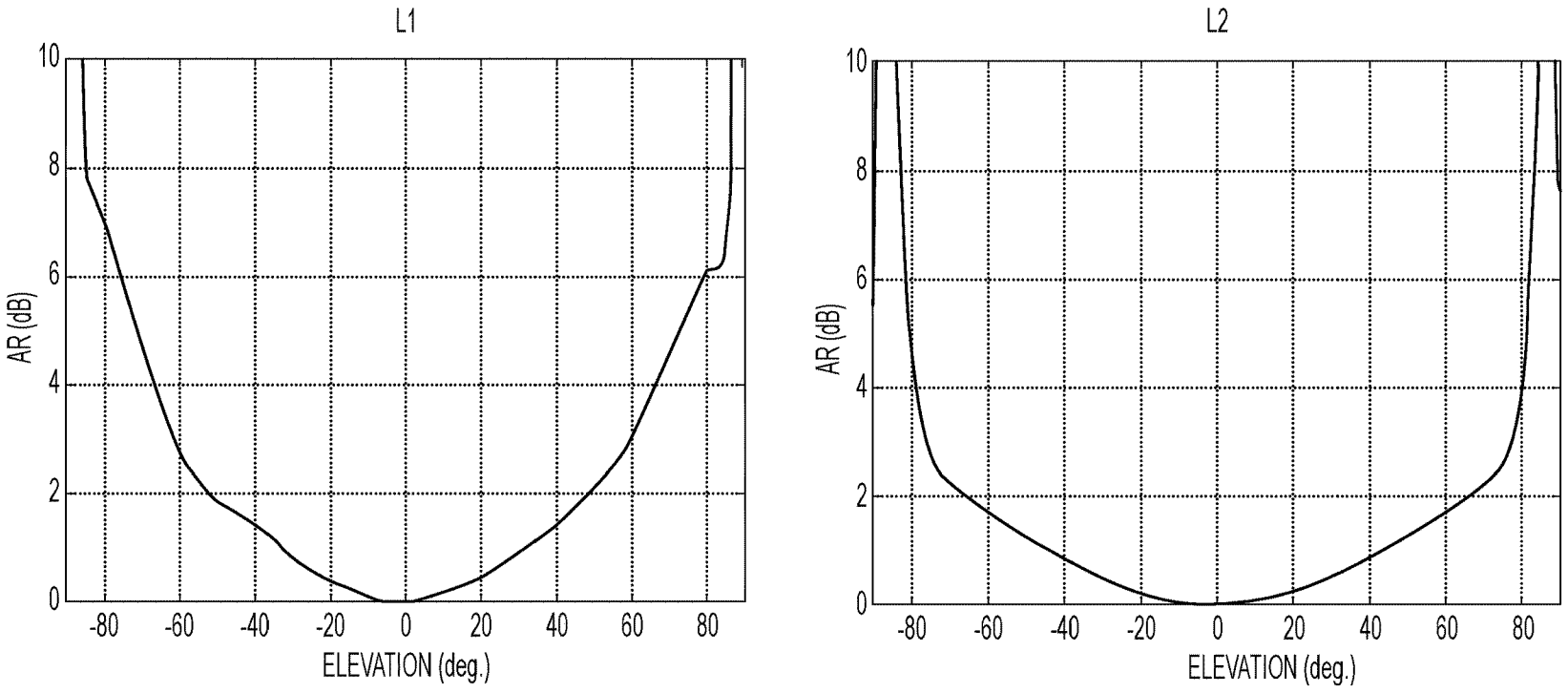
FIG. 8D illustrates simulated axial ratio versus elevation for a modeled dual-band antenna at the L1 and L2 frequency bands of the dual-band horizon nulling concentric quadrifilar helix antenna associated with FIGS. 8A-1, 8A-2.

FIG. 8C illustrates the simulated reflection coefficient for the modeled antenna at both the L1 and L2 frequency bands. It can be seen that the antenna is impedance matched for both the L1 and L2 frequency bands. The ripple in the L1 reflection coefficient is due to the trap circuits on the L2 helix, which are resonant at L1. According to some embodiments, the ripple may be reduced or eliminated by changing trap circuit configurations, for example, such that the peak impedance is outside of the L1 band. FIG. 8D illustrates the simulated axial ratio versus elevation for the modeled antenna at both the L1 and L2 frequency bands. As can be seen in the charts, the axial ratio is good within the main beam for both the L1 and L2 frequency bands.

Antennas can be configured with many different performance characteristics in accordance with the designs and principals described herein. In some embodiments, the HPBW can cover at least +/−90° from zenith (no horizon nulling), at least +/−80° from zenith, at least +/−70° from zenith, at least +/−60° from zenith, at least +/−50° from zenith, at least +/−40° from zenith, at least +/−20° from zenith, or at least +/−10° from zenith.

According to some embodiments, a null can be placed at a different location than the horizon, if desired, by adjusting the characteristics of the reactive elements. For example, the null can be placed at +/−60° from zenith, +/−45° from zenith, and so on.

Some embodiments may be configured with a peak gain greater than 2 dB, greater than 5 dB, greater than 7 dB, greater than 9 dB, or greater than 10 dB. Some embodiments may be configured with peak gain less than 20 dB, less than 15 dB, less than 10 dB, less than 5 dB, or less than 2 dB.

In some embodiments, the RHCP axial ratio at the center frequency can be less than 1 within +/−60° elevation. In some embodiments, the axial ratio can be less than 1 dB within +/−60° elevation, less than 1 dB within +/−45° elevation, less than 1 dB within +/−30° elevation, less than 1 dB within +/−20° elevation, or less than 1 dB within +/−10° elevation. In some embodiments, the RHCP axial ratio is less than 2 dB, less than 1.5 dB, less than 0.9 dB, less than 0.7 dB, less than 0.5 dB, less than 0.3 dB, or less than 0.1 dB within less than +/−60° elevation, within +/−45° elevation, or within +/−30° elevation.

Some embodiments can be configured with a minimum null depth around azimuth at center frequency that is at least −10 dB, at least −15 dB, at least −20 dB, at least −25 dB, at least −30 dB, or at least −40 dB. Some embodiments can be configured with a maximum null depth delta (difference between minimum null depth and maximum null depth around azimuth) at center frequency that is less than 1 dB, less than 2 dB, less than 3 dB, less than 5 dB, less than 10 dB, or less than 20 dB.

Antennas, according to some embodiments, can be configured to operate in other frequency bands according to the principles described above. For example, antennas can be configured to operate in other GNSS communication bands, such as the GLONASS and/or Galileo bands. Some embodiments can be configured to operate in other satellite communication bands, such as in the S-band (2 to 4 GHz), C-band (4 to 8 GHz), λ-band (8 to 12 GHz), and so on. Some embodiments can be configured to operate at lower frequencies, such as in the HF band (3 to 30 MHz), VHF band (30 to 300 MHz), and/or UHF band (300 to 1000 MHz). Some embodiments can operate over a Wireless Local Area Network (WLAN) in the 2.4 GHz and/or 5 GHz wireless bands in accordance with the IEEE 802.11 protocols.

In some embodiments, single-frequency antennas can be configured, according to the principles described above, to operate in any GNSS band, such as, but not limited to, GPS L1, L2, and L5, Gallileo G1, G2 and G6, Beidou L1 and L2, and GLONASS L1 and L2. Multi-band antennas, according to some embodiments, can be configured to operate in any combination of these, or other, GNSS bands. In some embodiments, a tri-band antenna is configured to operate in the GPS L1 and L2 and Galileo E6 frequency bands. In some embodiments, a quad-band antenna is configured to operate in GPS L1, L2, and L5 and Galileo E6 frequency bands.

The foregoing description, for the purpose of explanation, has been described with reference to specific embodiments. However, the illustrative discussions above are not intended to be exhaustive or to limit the invention to the precise forms disclosed. Many modifications and variations are possible in view of the above teachings. The embodiments were chosen and described in order to best explain the principles of the techniques and their practical applications. Others skilled in the art are thereby enabled to best utilize the techniques and various embodiments with various modifications as are suited to the particular use contemplated.

Although the disclosure and examples have been fully described with reference to the accompanying figures, it is to be noted that various changes and modifications will become apparent to those skilled in the art. Such changes and modifications are to be understood as being included within the scope of the disclosure and examples as defined by the claims. Finally, the entire disclosure of the patents and publications referred to in this application are hereby incorporated herein by reference.

The invention claimed is:

1. A helix antenna comprising:

a first radiating element extending helically about a longitudinal axis and tuned to resonate in a frequency band;

a reactive element electrically connected to a first end of the first radiating element; and a second radiating element extending helically about the axis and electrically connected to the reactive element at a first end of the second radiating element, wherein the second radiating element is tuned to resonate in the frequency band, wherein each of the first and second radiating elements is a continuous conductive material and forms at least a complete helical turn, and wherein the first and second radiating elements are configured for generating a gain null that extends circumferentially about the longitudinal axis.

2. The helix antenna of claim 1, wherein the reactive element is an inductor.

3. The helix antenna of claim 1, wherein the reactive element is configured to shift a phase of a signal generated by the second radiating element relative to a phase of a signal generated by the first radiating element such that the signal generated by the second radiating element destructively interferes with the signal generated by the first radiating element in a direction extending transversely to the longitudinal axis.

4. The helix antenna of claim 1, wherein the reactive element is configured to shift a phase of a signal generated by the second radiating element relative to a phase of a signal generated by the first radiating element such that the signal generated by the second radiating element constructively interferes with the signal generated by the first radiating element in a direction extending along the longitudinal axis.

5. The helix antenna of claim 1, wherein a second end of the first radiating element comprises a feed point for providing signals to the first and second radiating elements.

6. The helix antenna of claim 5, wherein the helix antenna generates a circularly polarized radiation field in response to receiving a signal through the feed point.

7. The helix antenna of claim 1, wherein a phase center of the second radiating element is displaced along the longitudinal axis of the phase center of the first radiating element such that a signal generated by the second radiating element constructively interferes with a signal generated by the first radiating element in a direction extending along the longitudinal axis.

8. The helix antenna of claim 1, wherein a peak of the gain null is at least 45° from the longitudinal axis.

9. The helix antenna of claim 1, wherein a peak of the gain null is at least 80° from the longitudinal axis.

10. The helix antenna of claim 1, wherein the gain null comprises a gain that is at least 20 decibels (dB) less than a gain at a zenith of the antenna.

11. The helix antenna of claim 10, wherein the gain is at least 30 dB less than the gain at the zenith of the antenna.

12. The helix antenna of claim 1, wherein the frequency band is an L1, L2, or L5 GPS frequency band.

13. The helix antenna of claim 1, wherein a helical pitch of the first radiating element is different than a helical pitch of the second radiating element.

14. The helix antenna of claim 1, wherein the first radiating element and the second radiating element each comprise greater than one turn.

15. The helix antenna of claim 1, wherein the antenna comprises four electrically conductive arms extending helically about the longitudinal axis, wherein one of the arms comprises the first and second radiating elements and the one or more reactive elements.

16. The helix antenna of claim 1, wherein a waveform generated by the first radiating element destructively interferes with a waveform generated by the second radiating element in a direction perpendicular to the longitudinal axis at a frequency in the frequency band.

17. The helix antenna of claim 1, wherein the antenna gain is at least half the magnitude of the gain at a zenith of the antenna at all angles less than or equal to 30° from the axis at an operating frequency.

18. The helix antenna of claim 1, wherein the gain null is at least partially located at the horizon.

19. A single-band helix antenna comprising:

multiple electrically conductive arms extending helically about a longitudinal axis from a first end of the antenna, wherein each arm comprises an upper segment, a lower segment, and at least one reactive element that electrically connects the upper segment to the lower segment, and wherein each of the upper and lower segments is a continuous conductive material and forms at least a complete helical turn;

a ground plane at the first end of the antenna that is electrically isolated from the multiple electrically conductive arms; and a feed network electrically connected to the multiple electrically conductive arms for feeding a circularly polarized signal, wherein the multiple electrically conductive arms are configured for generating a gain null that extends circumferentially about the longitudinal axis.

20. A helix antenna comprising:

at least one electrically conductive arm extending helically about a longitudinal axis from a first end of the antenna, wherein the at least one arm comprises an upper segment, a lower segment, and at least one reactive element that electrically connects the upper segment to the lower segment, wherein each of the upper and lower segments is a continuous conductive material and forms at least a complete helical turn, and wherein a waveform generated by the upper segment constructively interferes with a waveform generated by the lower segment in a direction extending along the longitudinal axis and destructively interferes with the waveform generated by the lower segment in a direction extending perpendicular to the longitudinal axis for generating a gain null that extends circumferentially about the longitudinal axis.

* * * * *